US009574859B2

(12) United States Patent
Zaun

(10) Patent No.: US 9,574,859 B2
(45) **Date of Patent: *Feb. 21, 2017**

(54) METHOD AND APPARATUS FOR THE DELABORATION OF AMMUNITION

(71) Applicant: Horst Zaun, Kollmar (DE)

(72) Inventor: Horst Zaun, Kollmar (DE)

( * ) Notice: Subject to any disclaimer, the term of this patent is extended or adjusted under 35 U.S.C. 154(b) by 376 days.

This patent is subject to a terminal disclaimer.

(21) Appl. No.: 14/250,144

(22) Filed: Apr. 10, 2014

(65) Prior Publication Data

US 2016/0245632 A1 Aug. 25, 2016

Related U.S. Application Data

(63) Continuation-in-part of application No. 14/083,158, filed on Nov. 18, 2013, now Pat. No. 9,021,931.

(51) Int. Cl.
*F42B 33/06* (2006.01)

(52) U.S. Cl.
CPC ..... *F42B 33/06* (2013.01)

(58) Field of Classification Search
CPC ..... F42B 33/06; F42B 33/062
USPC ..... 86/49–50
See application file for complete search history.

(56) References Cited

U.S. PATENT DOCUMENTS 5,974,937 A * 11/1999 Doughty ..... F42B 33/06 86/49
6,110,308 A * 8/2000 Ewald ..... C06B 21/0091 149/109.6
6,901,835 B1 * 6/2005 Chamlee ..... F42B 33/062 29/700
9,021,931 B1 * 5/2015 Zaun ..... F42B 33/06 86/49
2005/0109199 A1 * 5/2005 Chamlee ..... F42B 33/062 86/49
2010/0147177 A1 * 6/2010 Van Stratum ..... F42B 5/26 102/470
2016/0245632 A1 * 8/2016 Zaun ..... F42B 33/06

FOREIGN PATENT DOCUMENTS

DE 19736298 A1 2/1999
DE 20215938 U1 3/2003
DE 10251105 A1 5/2004

* cited by examiner

*Primary Examiner* — Michael David

(74) *Attorney, Agent, or Firm* — Lempia Summerfield Katz LLC

(57) ABSTRACT

A method and apparatus for the delaboration of ammunition, in particular for dismantling shells having a housing with a tubular housing portion made of steel and open at one end, a cone made of ductile metal and fitted into the tubular housing portion, the cone having a base with a tubular rim, and an explosive charge contained between the housing and the cone. The apparatus comprises a deformation tool, means for inserting the deformation tool into the tubular housing portion, an alignment tool for aligning the tubular housing portion with respect to the deformation tool, wherein the alignment tool has a recess for receiving an upper end of the tubular housing portion.

21 Claims, 17 Drawing Sheets

METHOD AND APPARATUS FOR THE DELABORATION OF AMMUNITION

RELATED APPLICATION DATA

The present application is a continuation-in-part of, and claims priority benefit of, co-pending U.S. application Ser. No. 14/083,158 filed Nov. 18, 2013 and entitled "Method and Apparatus for the Delaboration of Ammunition." The entire content of this prior filed application is hereby incorporated by reference herein.

BACKGROUND

1. Field of the Disclosure

The present invention relates to a method and apparatus for the delaboration of ammunition, in particular for delaborating shells originating from cluster bombs or cluster rockets and having a steel housing that contains an explosive charge and a ductile metal cone. More particularly the invention relates to a method and apparatus for dismantling ammunition having a housing with a tubular housing portion made of steel and being open at one end, a cone made of ductile metal and fitted into the tubular housing portion, the cone having a base with a short tubular rim, and an explosive charge contained between the housing and the metal cone.

2. Discussion of Prior Art

DE 197 36 298 A1 of the present applicant discloses a method and an apparatus for the delaboration of a shell with a steel housing that contains an explosive charge and a cone made from copper or a copper alloy. The steel housing consists of a tubular housing portion that adjoins an open end and a tapered housing portion that adjoins a closed end. The closed end of the tapered housing portion has three bores. Two of the bores are for fastening a detonator and parachute unit to the outer surface of the closed end. The bore in the middle serves for igniting the explosive charge. The cone is fitted into the housing so that the tip of the cone faces towards the detonator and is located in a distance from the closed end, whereas the base of the cone faces towards the open end. In order to fasten the cone securely within the housing to keep it in place even under high acceleration forces the base of the cone is provided with a short unitary tubular rim which is partially expanded during the assembly of the shell into a form fit with an inner circumferential groove provided on the inside of the tubular housing portion. The explosive charge consists of compacted RDX within the steel housing and located between the cone and the closed end. Upon ignition of the explosive charge the cone will direct a jet of hot gas and copper vapor through the open end.

Some armies possess large quantities of such shells. Due to the fact that cluster bombs or cluster rockets have been banned this ammunition has to be delaborated. A fast, reliable and non-expensive method for dismantling such shells is disclosed in DE 197 36 298 A1.

This method comprises: removing the parachute and detonator unit, locating the ammunition in an upright position on a support for alignment with a compression punch, the open end of the tubular housing portion facing upwardly, then moving the compression punch downwardly and axially compressing the tubular housing portion. When the pressure is high enough a length of the tubular housing portion will bulge outwardly adjacent to the circumferential groove. The tubular rim of the cone will not bulge together with the tubular housing portion so that it is released from the form fit with the groove. Then the cone can be withdrawn through the open end of the tubular housing portion and thereafter the explosive charge be removed. A disadvantage of the method and apparatus according to DE 197 36 298 A1 is that very high pressures are needed to deform the tubular housing portion of the shell in order to disengage the cone from the groove in the housing portion.

In addition to the type of shell mentioned above there is a further type of shell where the tubular housing portion is provided with an inner cylindrical aluminum liner or insert in order to avoid the need for milling a circumferential groove into the hard steel of the shell and thereby to facilitate its production. In this type of shell the circumferential groove is provided in the inner wall surface of the aluminum liner. An example of this type of shell is disclosed in DE 202 15 938 U1 of the applicant together with two different apparatuses and methods for delaborating or dismantling such a shell.

The apparatus of FIGS. 1a to 1d of DE 202 15 938 U1 comprises an extraction tool and a punch for pressing the extraction tool into the housing portion. The extraction tool comprises an annular blade delimited by a cylindrical outer surface and a conical inner surface and having a sharp blade edge at the intersection of the outer and inner surface. The cylindrical outer surface of the blade has a diameter that is equal to the inner diameter of the aluminum liner. The conical inner surface of the blade is steeply inclined and intersects the vertical axis of movement of the extraction tool at an inclination of less than 30 degrees. Inwardly from the conical inner surface the extraction tool is provided with a circumferential groove which is delimited by the conical inner surface of the annular blade and by an opposing conical surface having the same angle of inclination. In order to remove the cone from the tubular housing portion of the shell the extraction tool is moved into the tubular housing portion of the shell. When the sharp edge of the annular blade reaches the top end of the tubular rim of the cone it is forced by the punch between the aluminum liner and the rim. This will deflect the tubular rim inwardly so that it will enter the circumferential groove. Upon further downward movement of the extraction tool the movement of the tubular rim into the groove of the extraction tool will disengage the outer rim portion from the groove of the aluminum liner. When the extraction tool reaches the position in FIG. 1(b) the cone has been completely separated from the form fit with the aluminum liner and will only adhere to the explosive charge. In order to expose the explosive charge the punch is moved upwardly thereby withdrawing the cone from the shell. In order to remove the cone from the extraction tool the latter comprises an inner bore and an ejecting tool within the inner bore. The ejecting tool is axially movable relative to the extraction tool in order to push the cone downwardly out of engagement with the extraction tool after the cone has been withdrawn from the tubular housing portion of the shell, as can be seen in FIG. 1(d).

However this type of extraction tool is only suitable for dismantling shells having an aluminum liner. This is due to the fact that the sharp edge of the annular blade tends to break when it comes into contact with the inner surface of a tubular housing section made of steel.

Furthermore this type of extraction tool faces problems with shells where the tubular housing portion is provided with a small inwardly projecting steel rib that is either immediately adjacent to the inner circumferential groove and engages into the ductile metal of the tubular rim of the cone or that is immediately adjacent to an end face of the tubular rim. The purpose of this rib and of the circumferential groove is to hold the partially expanded tubular rim of the cone in place within the shell.

SUMMARY

The present disclosure relates to a method and apparatus for the delaboration of ammunition, in particular for delaborating shells originating from cluster bombs or cluster rockets and having a steel housing that contains an explosive charge and a ductile metal cone. More particularly the disclosure relates to a method and apparatus for dismantling ammunition having a housing with a tubular housing portion made of steel and being open at one end, a cone made of ductile metal and fitted into the tubular housing portion, the cone having a base with a short tubular rim, and an explosive charge contained between the housing and the metal cone.

In view of the foregoing it is an aim of the present disclosure to provide a method and apparatus which are suitable to remove the metal cone from shells or other ammunition without any aluminum liner and to considerably reduce the pressure needed to disengage the cone from the groove in the housing portion.

It is another aim of the present disclosure to provide a method and apparatus which are suitable to remove the metal cone from shells or other ammunition with a small inwardly projecting steel rib that engages into the ductile metal of the tubular rim of the cone or is located immediately adjacent to an end face of the tubular rim of the cone.

In order to achieve these aims the method according to the present invention comprises the following steps:

a) inserting a deformation tool through the open end into the tubular housing portion, b) engaging the deformation tool with the tubular rim of the metal cone, c) deforming at least a portion of the tubular rim with the deformation tool, d) aligning the tubular housing portion with respect to the deformation tool by engaging the tubular housing portion with a recess of an alignment tool that surrounds the deformation tool, wherein step d) precedes steps a) to c).

The apparatus according to the invention comprises at least one seat for receiving the ammunition and for holding the ammunition in a position, where the open end of the housing portion faces away from the seat; a deformation tool; means for inserting the deformation tool into the tubular housing portion; and an alignment tool for aligning the tubular housing portion with respect to the deformation tool, wherein the alignment tool has a recess for receiving an upper end of the tubular housing portion.

By engaging the tubular housing portion with a complementary recess of an alignment tool, where at least part of the recess is a close fit or a sliding fit with the outer circumference of the open end of the tubular housing portion and is coaxial to the deformation tool, it is possible to align or center the tubular housing portion and the deformation tool very exactly with respect to each other. Due to this the deformation tool will enter into the tubular housing portion without hitting an end face thereof. Furthermore the deformation tool will move very closely along the inner wall surfaces of the tubular housing portion so that the deformation tool can be used to shear off any inwardly and/or outwardly projecting rib.

In order to maintain the alignment of the tubular housing portion and the deformation tool with respect to each other it is preferable to clamp the housing between the alignment tool and a seat of a support that receives the ammunition. The orientation of the seat is preferably such that the open end of the tubular housing portion faces away from the seat.

According to a preferred embodiment of the invention the alignment tool is moved into engagement with the tubular housing portion before the deformation tool is introduced into the open end of the tubular housing portion in order to align or center the tubular housing portion with respect to the deformation tool before engaging the latter with the ammunition.

According to another preferred embodiment of the invention the method comprises shearing off an external portion of the tubular rim of the metal cone that is in engagement with an inner circumferential groove of the tubular housing portion and/or shearing off an inwardly projecting rib of the tubular housing portion. This is to eliminate the form fit of the cone's tubular rim with the inner circumferential groove and/or with the inwardly projecting rib of the tubular housing portion in order to be able to withdraw the metal cone from the tubular housing portion.

The withdrawal of the metal cone from the tubular housing portion can be performed immediately after the deformation of the tubular rim of the cone and the shearing off of the portions of the tubular rim and the tubular housing portion that are in mutual engagement and/or can be performed with the same tool. However in order to enhance the throughput of the method it is preferred to first deform the tubular rim of the cone and to shear off the portions of the tubular rim and the tubular housing portion that are in mutual engagement with a deformation tool in a first deformation station and then later withdraw the cone with a withdrawal tool in a second withdrawal station remote from the first station.

If the method is performed in two stations step c) is performed in the first station and comprises preferably deforming the tubular rim of the cone by means of a flat annular face of the deformation tool, wherein an angle of inclination of the flat annular face with respect to an axis of movement of the deformation tool exceeds 60 degrees, more advantageously 75 degrees. With such a configuration it is possible to deform the tubular rim of the cone radially inwardly and at the same time shear off any inwardly and/or outwardly projecting rib. After that the cone can be removed from the tubular housing portion by gripping the cone and exerting a withdrawal force upon the cone in an axial direction of the tubular housing portion in the second station.

In the apparatus according to the invention the alignment tool preferably surrounds the deformation tool and is axially movable with respect to the seat and to the deformation tool for clamping the housing between the alignment tool and the seat. Furthermore at least part of the recess is preferably a close fit or a sliding fit with the outer circumference of the open end of the tubular housing portion and is coaxial to the deformation tool.

Advantageously an upper end portion of the recess has an inner diameter which corresponds to or is slightly larger than an outer diameter of the tubular housing portion whereas a lower end portion of the recess is tapered or flared downwardly and outwardly in order to facilitate the entry of the tubular housing portion into the recess.

According to another preferred embodiment of the invention, the deformation tool has a flat annular face for engaging the tubular rim of the cone, wherein an angle of inclination of the flat annular face with respect to a movement axis of the extraction tool exceeds 60 degrees and/or wherein the flat annular face has a sharp outer edge and an outer diameter which is slightly less than an inner diameter of the tubular housing portion. This configuration facilitates an inward deformation of the tubular rim of the cone and the shearing off of any inwardly projecting rib of the tubular housing portion and/or any outwardly projecting portion of the tubular rim of the cone. In this way it is possible to disengage the cone from the tubular housing portion to such an amount that it can be removed from the housing portion by exerting a withdrawal force upon the cone in an axial direction of the tubular housing portion.

The withdrawal of the cone can be either performed with the extraction tool that has been used for the deformation of the tubular rim of the cone or can be preferably performed with a separate withdrawal tool. In the latter case advantageously the withdrawal tool has a plurality of spreadable jaws for gripping and withdrawing the cone from the tubular housing portion. The jaws preferably engage with an undercut beneath the deformed tubular rim of the cone. In order to keep the tubular housing portion stationary during the withdrawal of the cone the apparatus preferably comprises a clamping tool for clamping the housing in a seat of a support during the withdrawal of the cone.

In order to enhance the throughput of the apparatus the deformation tool and the alignment tool are advantageously in a first station whereas the withdrawal tool and the clamping tool are in a second station remote from the first station. In addition the apparatus comprises a conveyor for transporting the ammunition wherein the conveyor comprises the at least one seat for receiving the ammunition.

According to a preferred embodiment of the method steps a) to d) are performed after a preceding step of removing a detonator from the ammunition.

BRIEF DESCRIPTION OF THE DRAWINGS

Objects, features and advantages of the present invention will become apparent upon reading the following description in conjunction with the drawing figures, in which.

DETAILED DESCRIPTION OF THE DISCLOSURE

Figure 1:
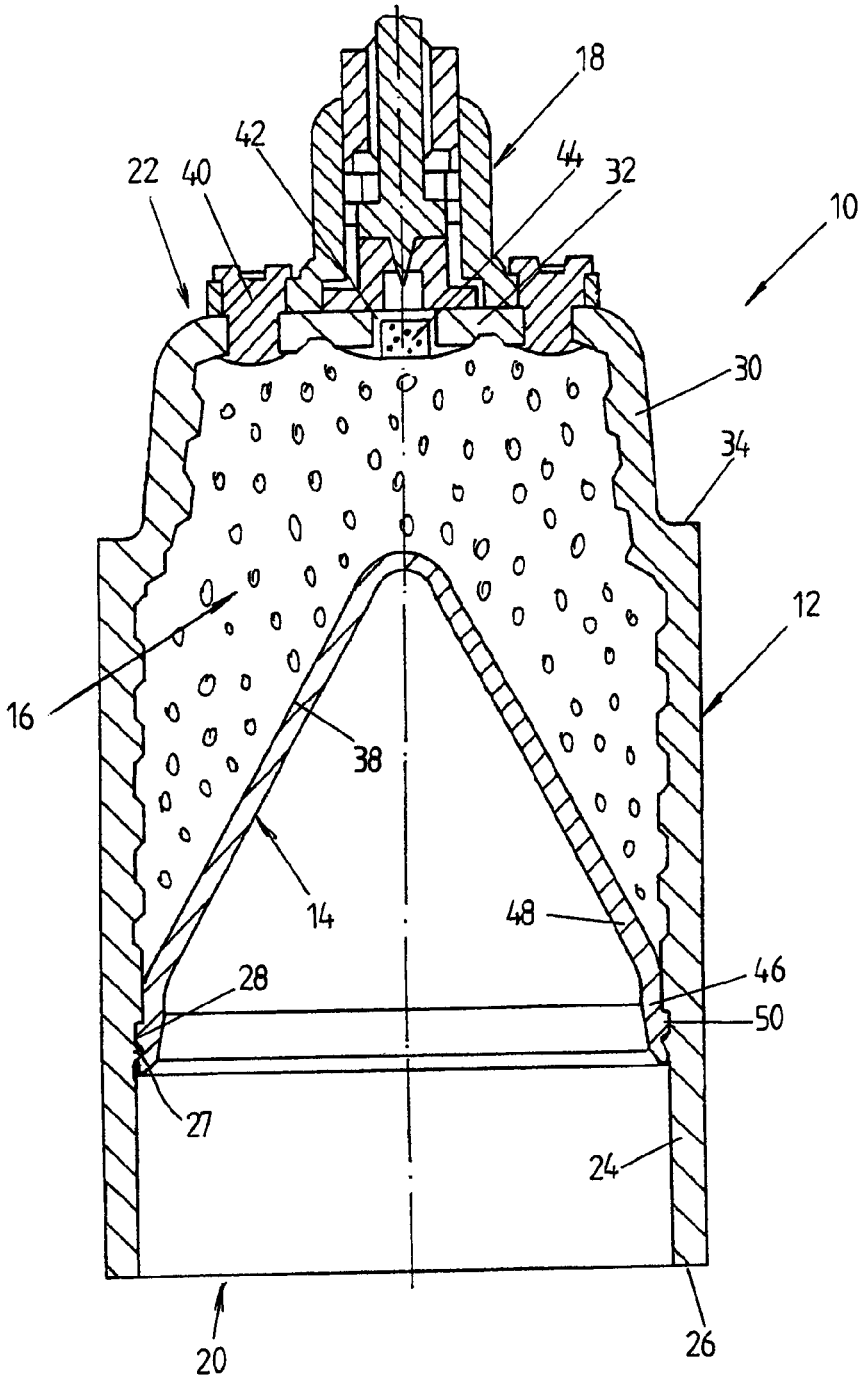
FIG. 1 is a sectional view of ammunition to be delaborated.

The apparatus depicted in the drawings is part of a plant for delaborating ammunition. The ammunition to be delaborated consists of shells 10 which are housed in cluster bombs or cluster rockets and are used especially for fighting tanks and other armored targets. An example of such a shell 10 is depicted in FIG. 1 of the drawing.

The shell 10 depicted in FIG. 1 comprises a body or housing 12, a metal cone 14 and an explosive charge 16 within the housing 12 and a detonator 18 outside the housing 12.

The one piece housing 12 has an open end 20 and a closed end 22 and is made of steel. The housing 12 comprises a first tubular housing portion 24 adjoining the open end 20. The tubular housing portion 24 has a plane end face 26 surrounding the open end 20 and is provided with an inner circumferential groove 28 in a distance from the open end 20 or end face 26. Towards the open end 20 the circumferential groove 28 is delimited by a thin inwardly projecting circumferential rib 27 of the housing portion 24. The inner diameter of the rib 27 is smaller than the inner diameter of the housing portion 24 that is beyond the cone 14. Together with the circumferential groove 28 the rib 27 serves to hold back the cone 14 within the shell. The housing 12 comprises a second tapered housing portion 30 adjoining the closed end 22 and comprising an end wall 32. Between the first and second housing portion 24, 30 there is a circumferential step or shoulder 34 that is parallel to the end face 26. The end wall 32 of the second housing portion 30 has two outer bores each housing a rivet 40 for fastening the detonator 18 to the end wall 32 and a central bore 42 holding a part 44 of a detonator charge, which is used for igniting the explosive charge 16.

The explosive charge 16 is located in a part of the housing 12 that is adjacent to the closed end 22. The explosive charge 16 consists of compacted RDX powder and is in contact with the detonator charge 44. The compaction of the RDX powder during the assembly of the shell 10 is performed with a conical tool having a rounded tip such that the compacted RDX has a conical depression 38 facing the open end.

The metal cone 14 is made of copper or a copper alloy. The cone 14 is fitted into the housing 12 in such a way that a rounded tip of the cone 14 faces towards the detonator 18 and a base of the cone 14 faces towards the open end 20. The tip is located in a distance from the end wall 32 and the base is located in a distance from the open end 20. The cone 14 comprises a conical portion 48 between the base and the tip. The shape of the conical portion 48 corresponds to the shape of the depression 38. At the base the cone 14 comprises a short tubular rim 46. During the assembly of the shell 10 the conical portion 48 of the prefabricated cone 14 is pressed into the depression 38 and then the ductile tubular rim 46 is partially expanded radially outwardly in order to achieve a form fit engagement of an external portion 50 of the rim 46 within the inner groove 28 of the tubular housing portion 24 and of the rib 27 with the rim 46 in order to fasten the cone 14 within the housing 12.

A large number of such shells 10 are arranged within a cluster bomb or cluster rocket (not shown). The cluster bomb or cluster rocket is activated in the air above the target. Upon activation the shells 10 are ejected from the bomb or rocket. Upon ejection from the bomb or rocket a parachute (not shown) attached to the detonator 18 will open. The shell suspended from the parachute will fall down and hit the target from above. When the shell 10 hits the target the detonator 18 will ignite the detonator charge 44 which in turn will ignite the explosive charge 16. Upon ignition of the explosive charge 16 the cone 14 will direct a jet of hot gas and copper vapor through the open end 20 in order to penetrate the armor of the target.

Due to the fact that cluster bombs have been banned a large amount of such shells 10 has to be delaborated. In order to avoid any accidents during the delaboration in a first step the detonator 18 is removed from the housing 12. This can be done in the manner described in DE 197 36 298 A1. Reference is made to this description.

After the removal of the detonator 18 the rest of the shell 10 consisting of the steel housing 12, the detonator charge 44, the explosive charge 16 and the metal cone 14 is delaborated by separating and removing the cone 14 from the housing 12 in order to create an access for oxygen from the ambient air to the explosive charge 12 which will permit burning the explosive charge 16 without any risk of explosion.

The separation and removal of the cone 14 from the housing 12 is achieved with the apparatus depicted in the drawings, where FIGS. 2 to 13 show a first embodiment with only one station, where a single extraction tool is used to deform the tubular rim of the cone and to at least partially withdraw the cone from the housing portion, and where FIGS. 14 to 22 show a second embodiment with two separate stations and two separate tools, namely a deformation tool for deforming the tubular rim of the cone in the first station and a withdrawal tool for withdrawing the cone from the housing portion in the second station. Identical numerals denominate identical components of both embodiments.

As can be best seen from FIGS. 2 to 13 the first embodiment of the apparatus comprises a support 52 with a through opening 54, a receptacle or holder 56 for the housing 12, the holder 56 being received in the through opening 54, an extraction tool 58, a punch 60 carrying the extraction tool 58, an alignment tool 62 surrounding the extraction tool 58 and an ejection tool 64 within a central bore 66 of the extraction tool 58. The through opening 54, the holder 56, the extraction tool 58, the alignment tool 62 and the ejection tool 64 are all coaxial to a vertical central axis 66 of the apparatus that is aligned with the central axis of the through opening 54 and the holder 56.

The support 52 and the holder 56 are both arranged in a lower part of the apparatus. The support 52 is provided with a plane upper surface for supporting a downwardly facing shoulder 68 of the holder 56 and receives a lower cylindrical portion of the holder in a form fit within the through opening 54.

The holder 56 is provided with a central through bore 70 for receiving the shell 10 that is depicted in FIGS. 2 to 13 in a somewhat simplified manner. The support 52 and the holder 56 inserted into the bore 70 provide a seat for the shell 10. The shell 10 is inserted into the seat in an orientation where the open end 20 faces upwardly towards the extraction tool 58 and where the closed end 22 faces downwardly through the open bottom end of the bore 70. The bore 70 consists of a lower section and an upper section. The lower section has an inner diameter that corresponds to the maximum outer diameter of the tapered housing portion 30. The upper section has an inner diameter that corresponds to the outer diameter of the tubular housing portion 24. The upper end of the upper section is somewhat tapered or flared upwardly in order to facilitate the insertion of the shell 10 into the bore 70. The upper section and the lower section are separated by an upwardly facing shoulder 72 which is orthogonal to the central axis 66 and supports the shoulder 34 of the housing 12 when the shell is in the seat. The distance of the shoulder 72 from a plane upper surface of the holder is such that the tubular housing portion 24 protrudes upwardly from the bore 70.

The punch 60, the alignment tool 62, the extraction tool 58 and the ejection tool 64 are arranged in an upper part of the apparatus above the seat. The upper end (not shown) of the punch 60 is connected to a ram (not shown) of a hydraulic press. The bottom end of the punch 60 carries the extraction tool 58 that is screwed into a threaded axial bore in the bottom end of the punch 60.

The alignment tool 62 is made of steel and has a tubular shape that is open at its upper end in order to receive the punch 60 and the extraction tool 58. A thick bottom wall 74 of the alignment tool 62 is provided with a central through bore for the extraction tool 58. The bottom end of the bore opens into a recess 76 that is coaxial to the axis 66. The recess 76 has an upper section with an inner diameter that corresponds to the outer diameter of the tubular housing portion 24. A lower end section of the recess 76 is tapered or flared downwardly in order to facilitate the entry of the top end of the tubular housing portion 24 into the recess 76. Between the two sections there is a shoulder 78 that faces downwardly. The width of the shoulder 78 is somewhat less than the width of the upper end face 26 of the tubular housing portion 24 as can be best seen from FIG. 5.

The extraction tool 58 is made of hardened steel and has a tubular shape with a circular cross section. An outer diameter of the extraction tool 58 corresponds to an inner diameter of the tubular housing portion 24 of the shell 10. The upper end of the extraction tool 58 is provided with a thread (not shown). Close to the bottom end the extraction tool is provided with a circumferential groove 80 and a blunt annular compression face 82. The circumferential groove 80 has an opening that faces radially outwardly. The circumferential groove is delimited by an upper side face, a lower side face and an inner end face between the upper and lower side face. The upper side face and the lower side face are orthogonal to the axis 66. The upper side face merges into the annular compression face 82 which is also orthogonal to the axis 66. There is a sharp 90 degree edge 84 between the annular compression face 82 and a cylindrical outer surface of the tubular extraction tool 58.

In another embodiment (not shown) the upper side face and the lower side face of the circumferential groove 80 as well as the blunt compression face 82 may be inclined with respect to the axis 66 radially outwardly and downwardly with an angle of inclination that does not exceed 30 degrees.

The lower side face of the circumferential groove 80 is the upper surface of an annular ledge 86 that protrudes radially outwardly below the circumferential groove 80. The maximum outer diameter of the ledge 86 corresponds to the inner diameter of the tubular rim 46 of the cone 14 as can be best seen from FIG. 7. From the ledge 86 the extraction tool 58 tapers downwardly and inwardly towards a plane end face 88. The inclination of the taper corresponds to the inclination of the conical portion 48 of the cone 14 as can be best seen from FIG. 7.

The ejection tool 64 is a rod that is movable with respect to the extraction tool 58 within a central bore of the tool 58. The solid ejection tool 64 has a plane bottom end and a taper 90 between the plane bottom end and a cylindrical outer surface of the rod. The inclination of the taper 90 corresponds to the inclination of the conical portion 48 of the metal cone 14 as can be best seen from FIG. 11.

Figure 2:
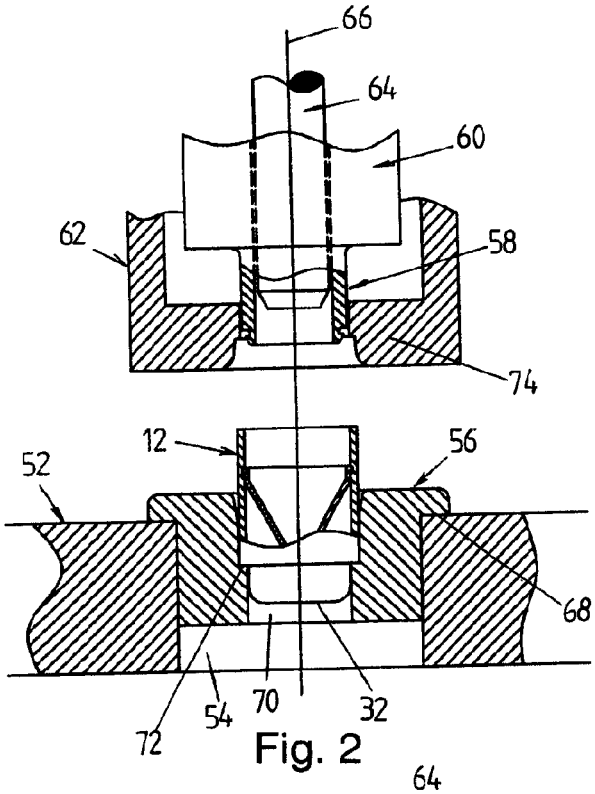
FIG. 2 is a partially cut off view of a first embodiment of an apparatus for removing a metal cone from the ammunition in an initial or starting position of a removal process, after having dismantled the detonator.
Figure 3:
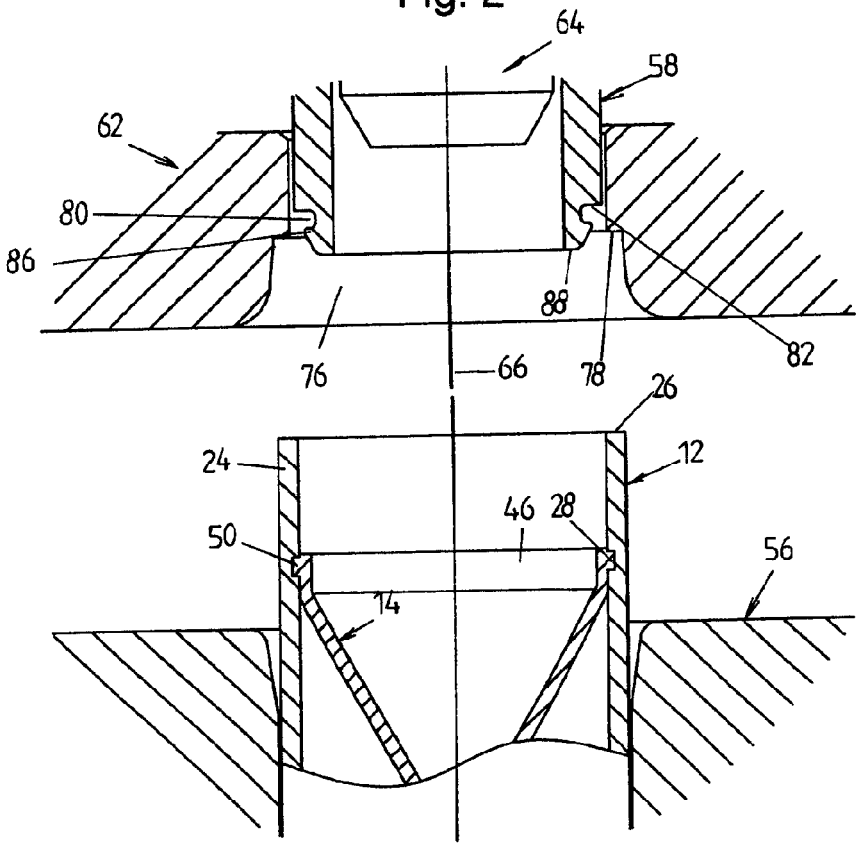
FIG. 3 is an enlarged detailed view of a central portion of FIG. 2.

The function of the first embodiment of the apparatus will be explained in the following: In an initial or starting position of a process for separating and removing the metal cone 14 from the shell 10 the housing 12 is in the seat of the holder 56 and the holder 56 is in the bore 54 of the support 52, as shown in FIGS. 2 and 3. The punch 60 with the extraction tool 58 and the alignment tool 62 are in an upper end position in a distance above the seat. The stationary ejection tool 62 protrudes downwardly from the bore of the extraction tool 58.

Figure 4:
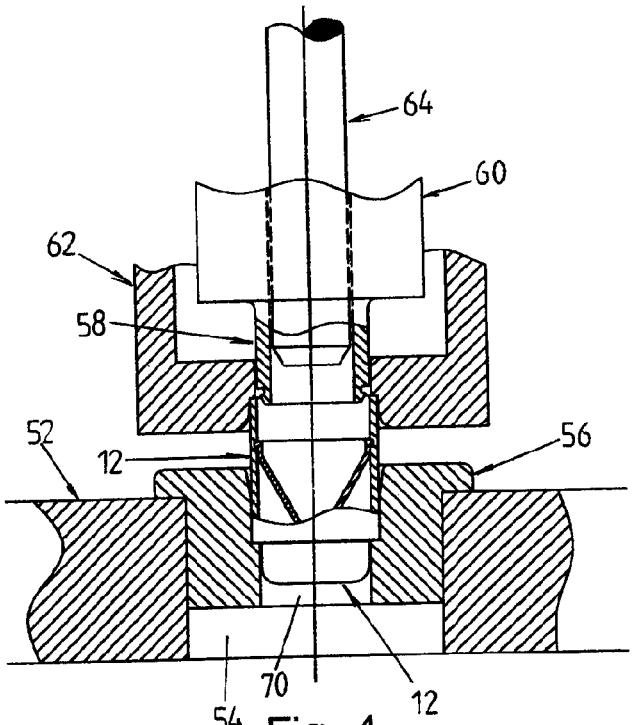
FIG. 4 is a view corresponding to FIG. 2 during a first step of the removal process.
Figure 5:
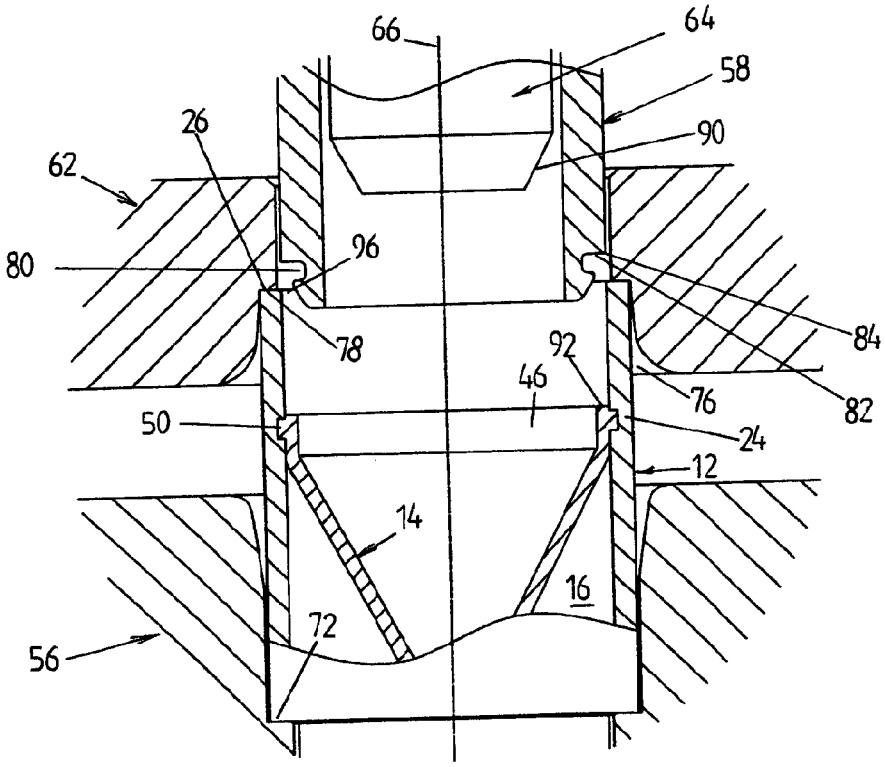
FIG. 5 is an enlarged detailed view of a central portion of FIG. 4.
Figure 6:
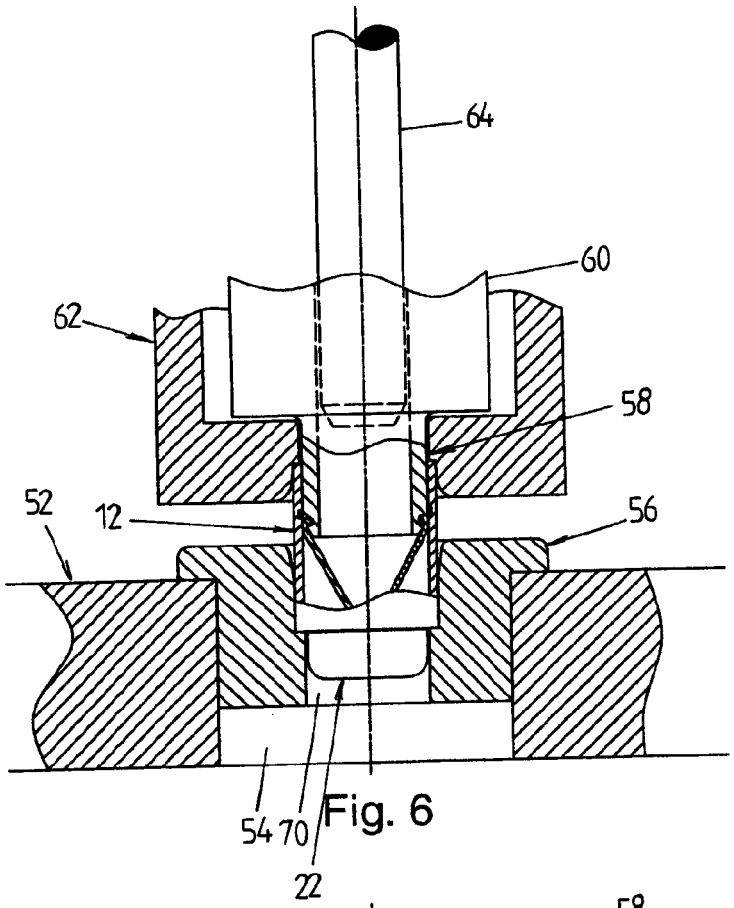
FIG. 6 is a view corresponding to FIGS. 2 and 4 during a second step of the removal process.
Figure 7:
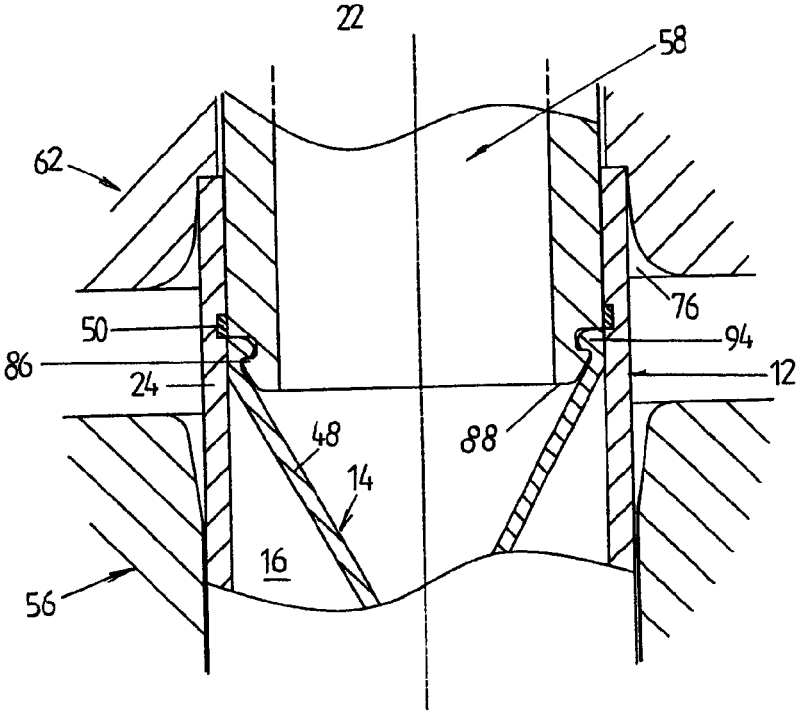
FIG. 7 is an enlarged detailed view of a central portion of FIG. 6.

In a first step of the process, as shown in FIGS. 4 and 5, the alignment tool 62 is moved downwardly with respect to the punch 60, the extraction tool 58 and the ejection tool 64 into a position where the shoulder 78 rests upon the end face 26 of the tubular housing portion 24 and the tubular housing portion 24 is clamped between the alignment tool 62 and the shoulder 72 of the holder 56. As can be best seen from FIG. 5 in this position the alignment tool 62 will align the upper end of the tubular housing portion 24 with respect to the axis 66 of the punch 60, the extraction tool 58 and the ejection tool 64 so that the tubular housing portion 24 will be centered with respect to the axis 66. At the end of the first step the bottom end of the extraction tool 58 protrudes slightly into the upper end of the tubular housing portion 24 however the extraction tool 58 neither contacts the housing portion 24 nor the cone 14. The ejection tool 64 is kept stationary during the first step.

In a second step of the process the punch 60 with the extraction tool 58 is moved downwardly with respect to the alignment tool 62 and the ejection tool 64 into the interior of the tubular housing portion 24. When the blunt compression face 82 passes the level of an upper end face 92 of the tubular rim 46 of the cone 14 an upper end portion 94 of the tubular rim 46 will be compressed and deformed by the axial downward forces of the punch 60 that are exerted from the blunt compression face 82 onto the upper end face 92 of the tubular rim 46, as can be seen from FIGS. 6 and 7. During the compression and the deformation of the upper end portion 94 of the tubular rim 46 some of the ductile metal of the upper end portion 94 will yield into the circumferential groove 80 of the extraction tool 58. By appropriately selecting the length of the stroke of the punch 60 and extraction tool 58, i.e. about 1.8 mm from the contact of the compression face 82 with the end face 92, the compressed and deformed upper end portion 94 will engage with the groove 80 in a form fit. At the same time the external portion 50 of the tubular rim 46 within the groove 28 will be sheared off from the rest of the tubular rim 12 along the inner surface of the tubular housing portion 24 as can be best seen from FIG. 7. In order to prevent the ductile metal of the rim 46 from buckling or yielding anywhere else the rim 46 is constrained below the lower side face of the groove 80 in a gap 96 between the ledge 86 and the inner surface of the tubular housing portion 24 that acts as an abutment for the ductile metal of the rim 46. The lower end of the tubular rim 46 is pressed against the explosive charge 16 that also acts as an abutment preventing the rim 46 from yielding in this direction. At the end of the second step the deformed upper end portion 94 of the rim 46 is in form fit engagement with the groove 80 whereas there is only a frictional fit engagement between the outer peripheral surface of the rim 46 and the opposing inner surface of the tubular housing portion 24. The ejection tool 64 is kept stationary during the second step.

Figure 8:
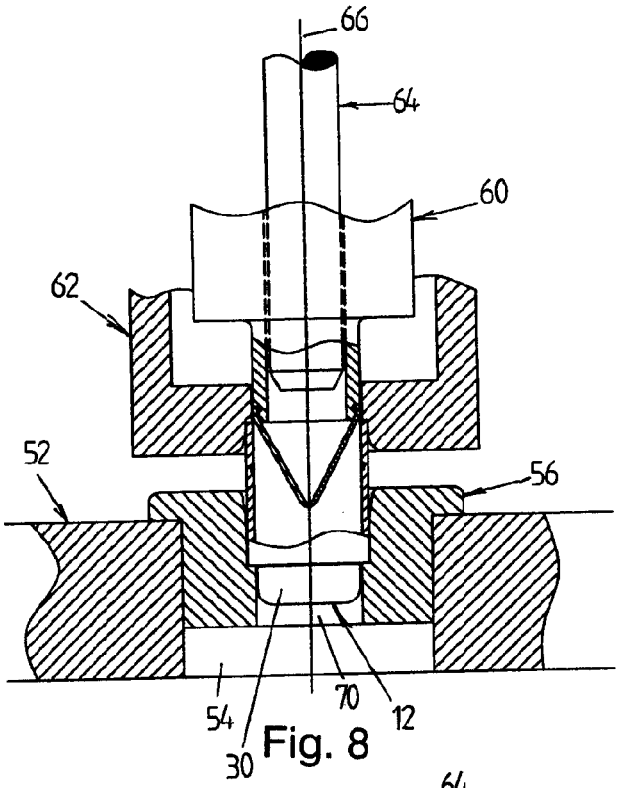
FIG. 8 is a view corresponding to FIGS. 2, 4 and 6 during a third step of the removal process.
Figure 9:
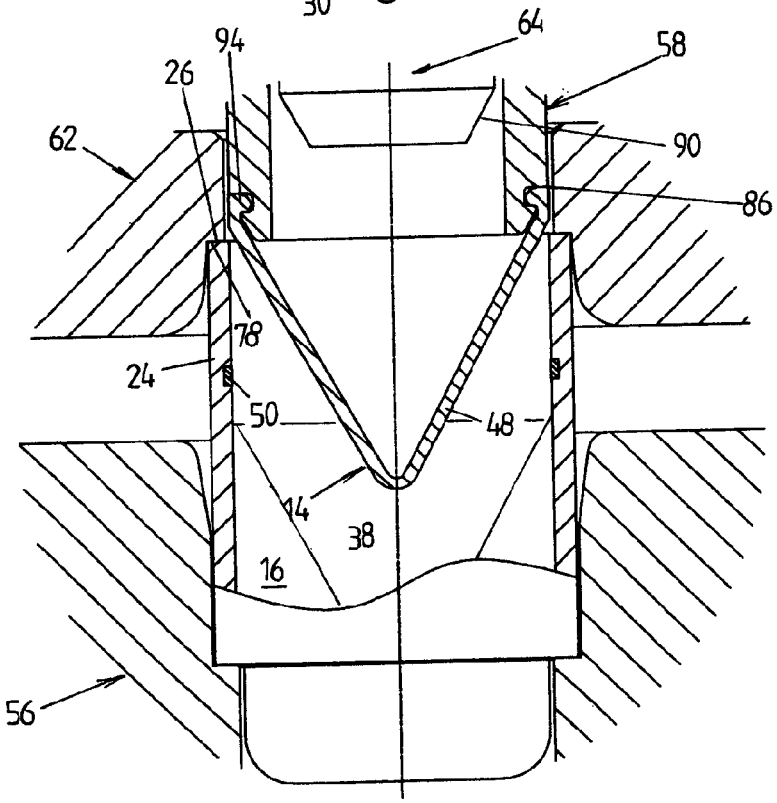
FIG. 9 is an enlarged detailed view of a central portion of FIG. 8.

In a third step of the process as shown in FIGS. 8 and 9 the punch 60 with the extraction tool 58 is moved upwardly with respect to the alignment tool 62 and the ejection tool 64. Due to the fact that the axial forces required to eliminate the form fit engagement of the deformed upper end portion 94 of the rim 46 with the extraction tool 58 exceed the frictional forces required to withdraw the metal cone 14 from the tubular housing portion 24 the metal cone 14 is moved upwardly together with the extraction tool 58 until the tubular rim 46 has left the tubular housing portion 24. The sheared off external portion 50 of the tubular rim 46 will remain within the groove 28. The alignment tool 62 acts as a hold-down clamp to hold down the housing 12 in the seat during the withdrawal of the cone 14. The ejection tool 64 is kept stationary during the third step.

Figure 10:
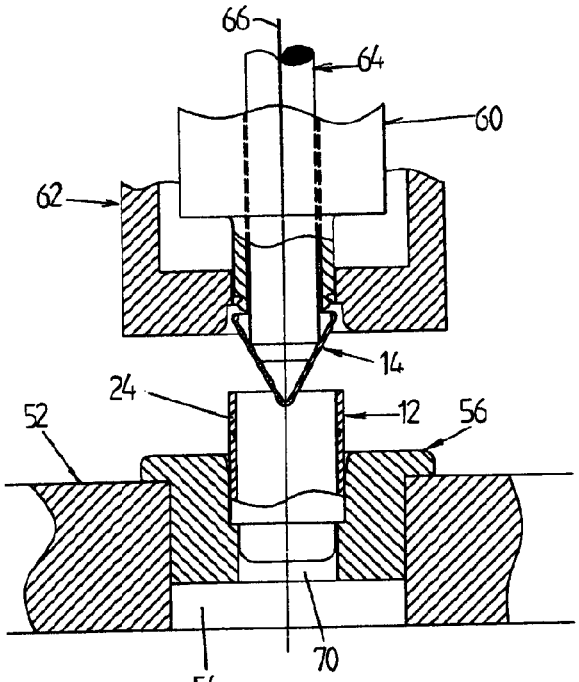
FIG. 10 is a view corresponding to FIGS. 2, 4, 6 and 8 during a fourth step of the removal process.
Figure 11:
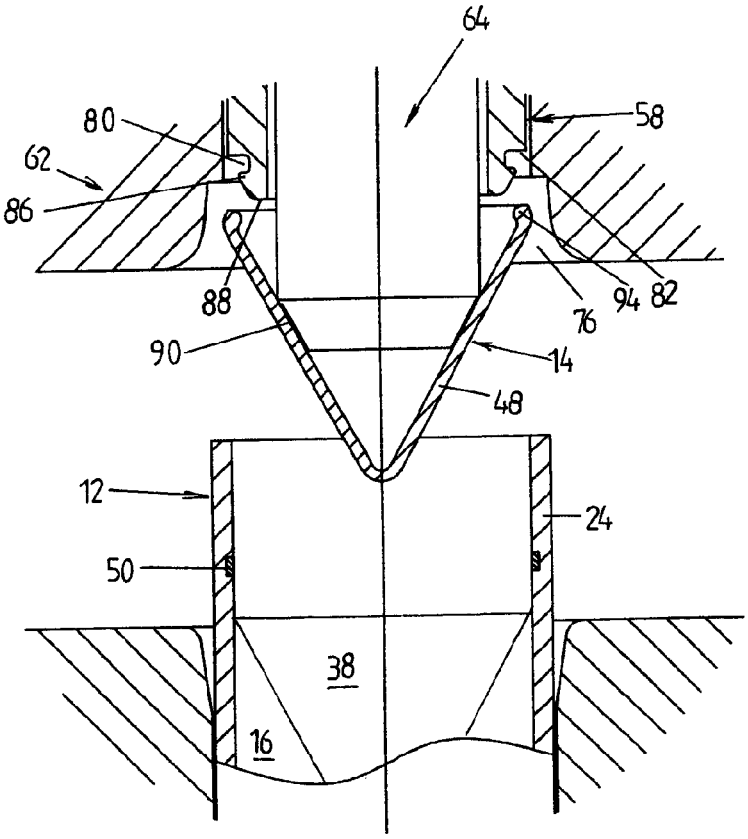
FIG. 11 is an enlarged detailed view of a central portion of FIG. 10.

In a fourth step of the process as shown in FIGS. 10 and 11 the punch 60 with the extraction tool 58 and the alignment tool 62 are moved further upwardly into their upper end position that corresponds to their upper end position in FIGS. 2 and 3. The ejection tool 64 is kept stationary so that the upper or inner surface of the conical portion 48 of the metal cone 14 will hit the taper 90 at the bottom end of the ejection tool 64 before the punch 60 with the extraction tool 58 and the alignment tool 62 reach their upper end position. This will stop the upward movement of the cone 14 while the extraction tool 58 is moved further upwardly. Due to this the deformed upper end portion 94 of the rim 46 is disengaged from the form fit engagement with the groove 80. The vertical position of the bottom end of the ejection tool 64 is such that the tip of the metal cone 14 has not yet been withdrawn from the tubular housing portion 24 when the upper end portion 94 of the rim 46 is disengaged from the groove 80. Therefore the cone 14 will fall back onto the top end of the tubular housing portion 24, as best shown in FIG. 12.

Figure 12:
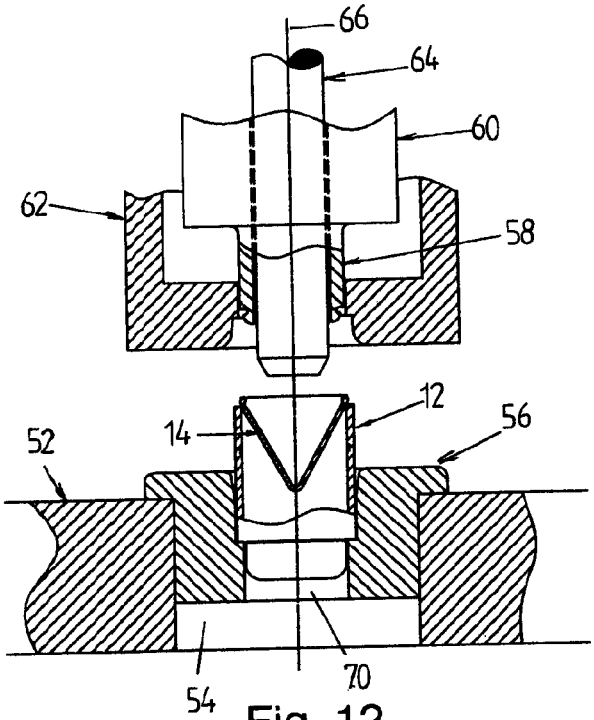
FIG. 12 is a view corresponding to FIGS. 2, 4, 6, 8 and 10 at the end of the removal process.
Figure 13:
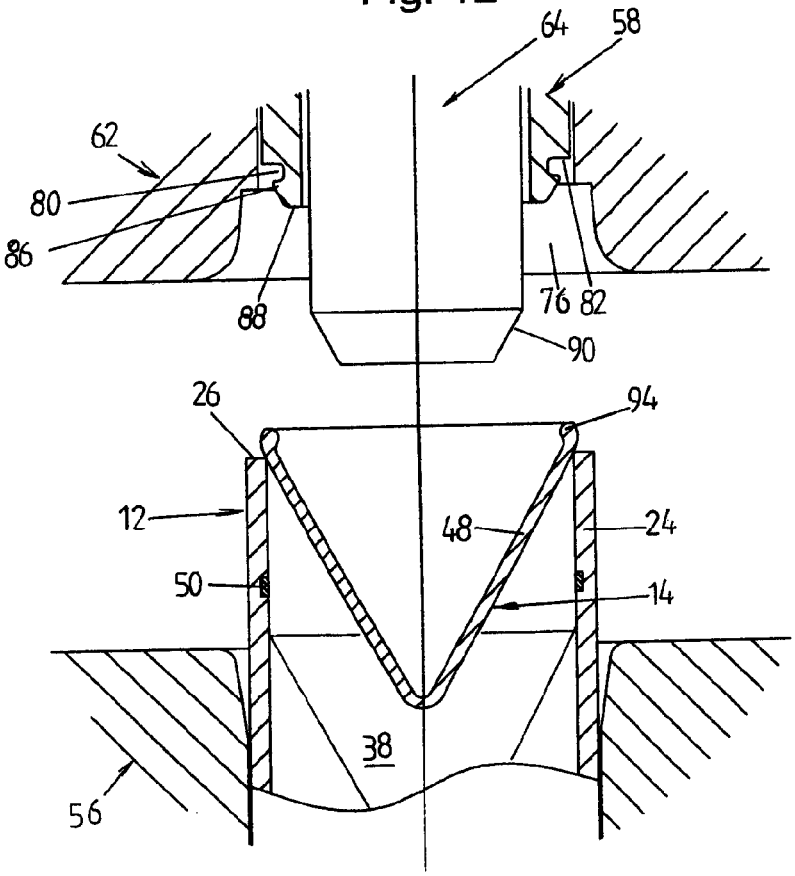
FIG. 13 is an enlarged detailed view of a central portion of FIG. 12.

In the end position of the process as shown in FIGS. 12 and 13 the punch 60 with the extraction tool 58 and the alignment tool 62 have reached again their upper end position. The cone 14 is loosely supported on the housing 12 with the base of the cone 14 resting on the upper end of the tubular housing portion 24 and the tip of the cone 14 being within the tubular housing portion 24. In this position the support 52 with the holder 56, the dismantled shell 10 and the metal cone 14 can be moved to the next station in the plant for burning the explosive charge 16 within the housing 12 and adhering to the cone 14.

In contrast to the first embodiment the second embodiment comprises a first cone deforming station 104 depicted in FIGS. 14 to 18, where the upper end portion 94 of the tubular rim 46 of the cone 14 is deformed by means of a deformation tool 102, and a second cone withdrawal station 108 as depicted in FIGS. 19 to 22, where the cone 14 is removed from the housing 12 by means of a gripping or withdrawal tool 106.

The second embodiment further comprises a support 52 with a through opening 54, a two part receptacle or holder 56 for the housing 12, the holder 56 being received in the through opening 54. The support 52 and the holder 56 are part of a conveyor system (not shown) that can transport the support 52 and the holder 56 together with the shell 10 received in the central bore 70 of the holder 56 from the cone deforming station 104 to the cone withdrawal station 106.

The cone deforming station 104 comprises the deformation tool 102, a punch 60 carrying the deformation tool 102 and an alignment tool 62 surrounding the deformation tool 102. The deformation tool 102, the punch 60 and the alignment tool 62 are all coaxial to a vertical central axis 66 of the cone deforming station 104.

The support 52 and the holder 56 are both arranged in a lower part of the apparatus or stations 104, 108. The support 52 is provided with a plane upper surface for supporting a downwardly facing shoulder 68 of the holder 56 and receives a lower cylindrical portion of the holder in a form fit within the through opening 54. When the support 52 it moved into the first station 104 the central axis of the through opening 54 and the holder 56 will be aligned with the vertical central axis 66.

The two part holder 56 is provided with a central through bore 70 for receiving the shell 10. The support 52 and the holder 56 inserted into the through opening 54 provide a seat for the shell 10. The shell 10 is inserted into the seat in an orientation where the open end 20 faces upwardly towards the deformation tool 102 and where the closed end 22 faces downwardly through the open bottom end of the bore 70. The bore 70 consists of a lower section and an upper section. The lower section has an inner diameter that corresponds to the maximum outer diameter of the tapered housing portion 30. The upper section has an inner diameter that corresponds to the outer diameter of the tubular housing portion 24. The upper end of the upper section is somewhat tapered or flared upwardly in order to facilitate the insertion of the shell 10 into the bore 70. The upper section and the lower section are separated by an upwardly facing shoulder 72 which is orthogonal to the central axis 66 and supports the shoulder 34 of the housing 12 when the shell is in the seat. The distance of the shoulder 72 from a plane upper surface of the holder 56 is such that the tubular housing portion 24 protrudes upwardly from the bore 70.

The punch 60, the alignment tool 62 and the deformation tool 102 are arranged in an upper part of the station 102. The upper end (not shown) of the punch 60 is connected to a ram (not shown) of a hydraulic press. The bottom end of the punch 60 carries the deformation tool 102. In contrast to the first embodiment the second embodiment does not comprise any ejector.

The alignment tool 62 is made of steel and has a tubular shape that is open at its upper end in order to receive the punch 60 and the deformation tool 102. A thick bottom wall 74 of the alignment tool 62 is provided with a central through bore for the deformation tool 102. The bottom end of the bore opens into a recess 76 that is coaxial to the axis 66. The recess 76 has an upper section with an inner diameter that corresponds to the outer diameter of the tubular housing portion 24. A lower end section of the recess 76 is tapered or flared downwardly in order to facilitate the entry of the top end of the tubular housing portion 24 into the recess 76. Between the two sections there is a shoulder 78 that faces downwardly. The width of the shoulder 78 is somewhat less than the width of the upper end face 26 of the tubular housing portion 24, as can be best seen from FIG. 15.

The deformation tool 102 is made of hardened steel and has a large diameter upper portion 110 and a small diameter lower portion 112. The upper portion 110 comprises an annular flange that faces upwardly and is fastened by screw bolts to a corresponding flange at the bottom end of the punch 60. The lower portion 106 has a tubular shape with a circular cross section. An outer diameter of the lower portion 106 corresponds to or is slightly less than an inner diameter of the tubular housing portion 24 of the shell 10. At the bottom end the lower portion is provided with a flat annular face 114 and a circumferential shearing edge 116 at the outer circumference of the annular face 114. The annular face 114 is inclined with respect to the axis 66 radially outwardly and downwardly towards the shearing edge 115 with an angle of inclination of about 15 degrees.

The cone withdrawal station 108 comprises the gripping and withdrawing tool 106, a hydraulic drive (not shown) for raising and lowering the gripping and withdrawing tool 106 with respect to the support 52 and the holder 56 and a guiding and clamping plate 114 for guiding the tool 106 and for clamping or pressing the shell 10 into the seat of the holder 56 and the support 52 during the extraction or withdrawal of the cone 14 from the housing 12. The gripping and withdrawing tool 106 and the guiding and clamping plate 114 are coaxial to a vertical central axis 116 of the station 108. When the support 52 with the holder 56 is moved into the second station 108, the central axis of the through opening 54 and the holder 56 are aligned with the vertical central axis 116.

Figure 20:
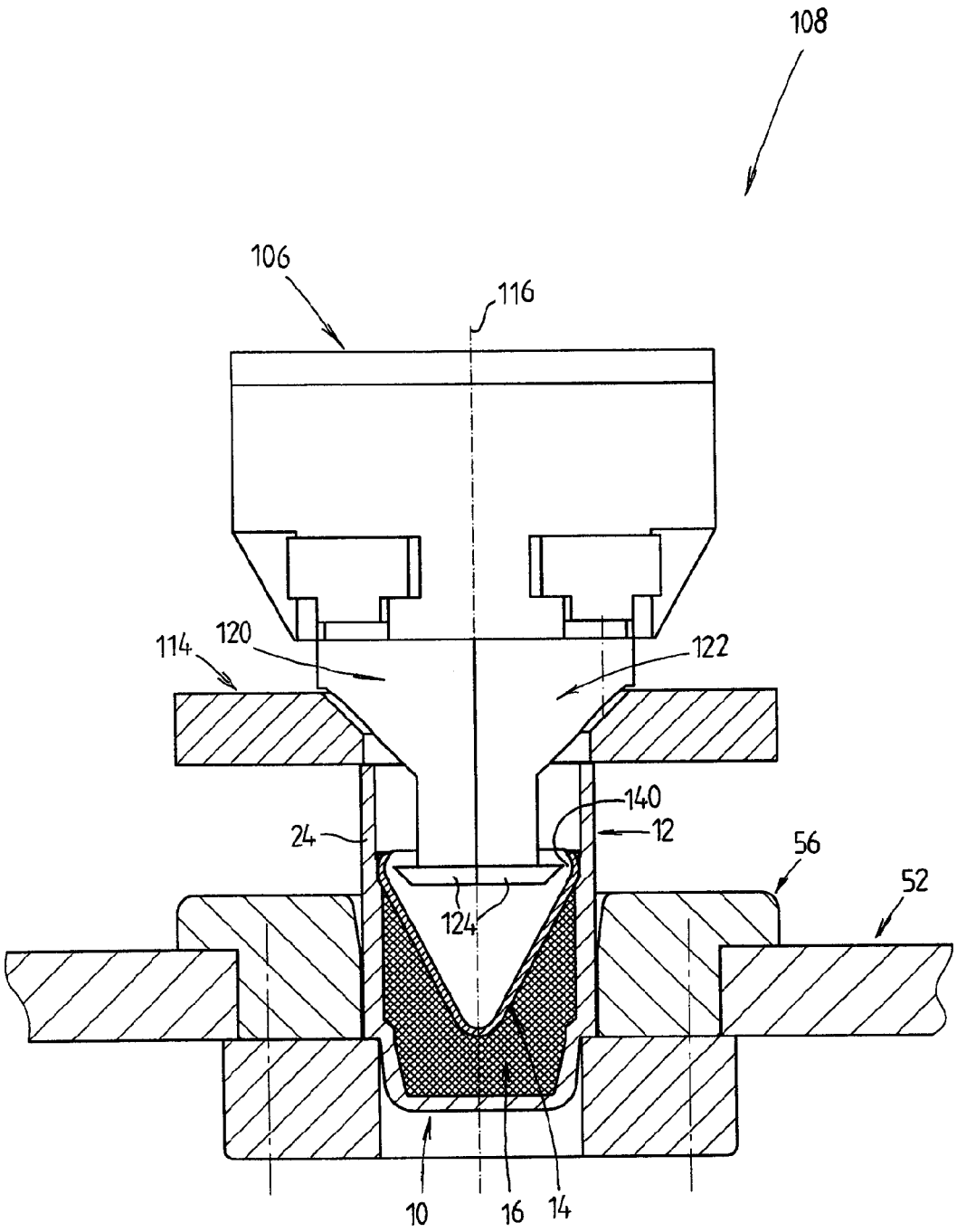
FIG. 20 is a view corresponding to FIG. 19 during a fifth step of the removal process.
Figure 21:
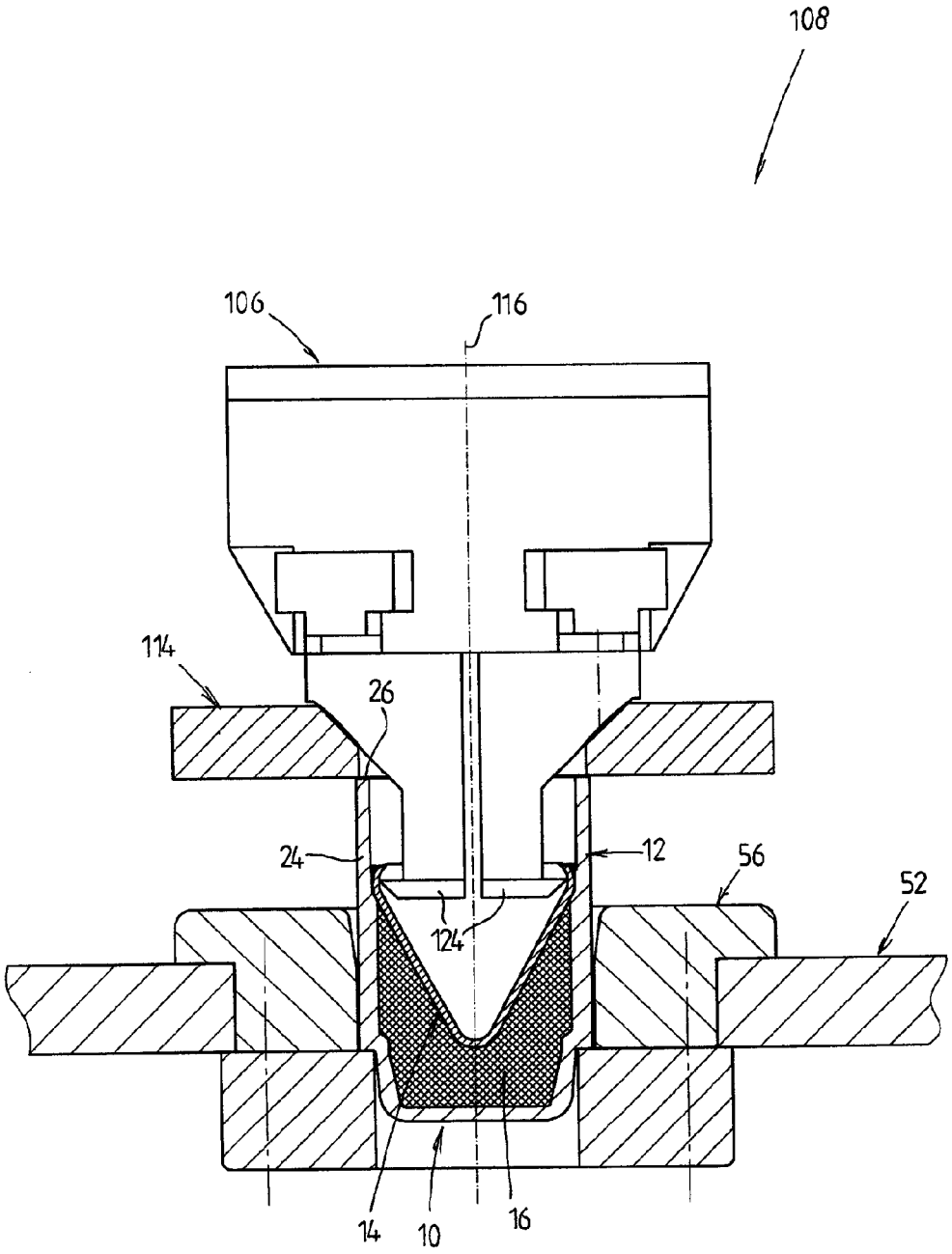
FIG. 21 is a view corresponding to FIGS. 19 and 20 during a sixth step of the removal process.
Figure 22:
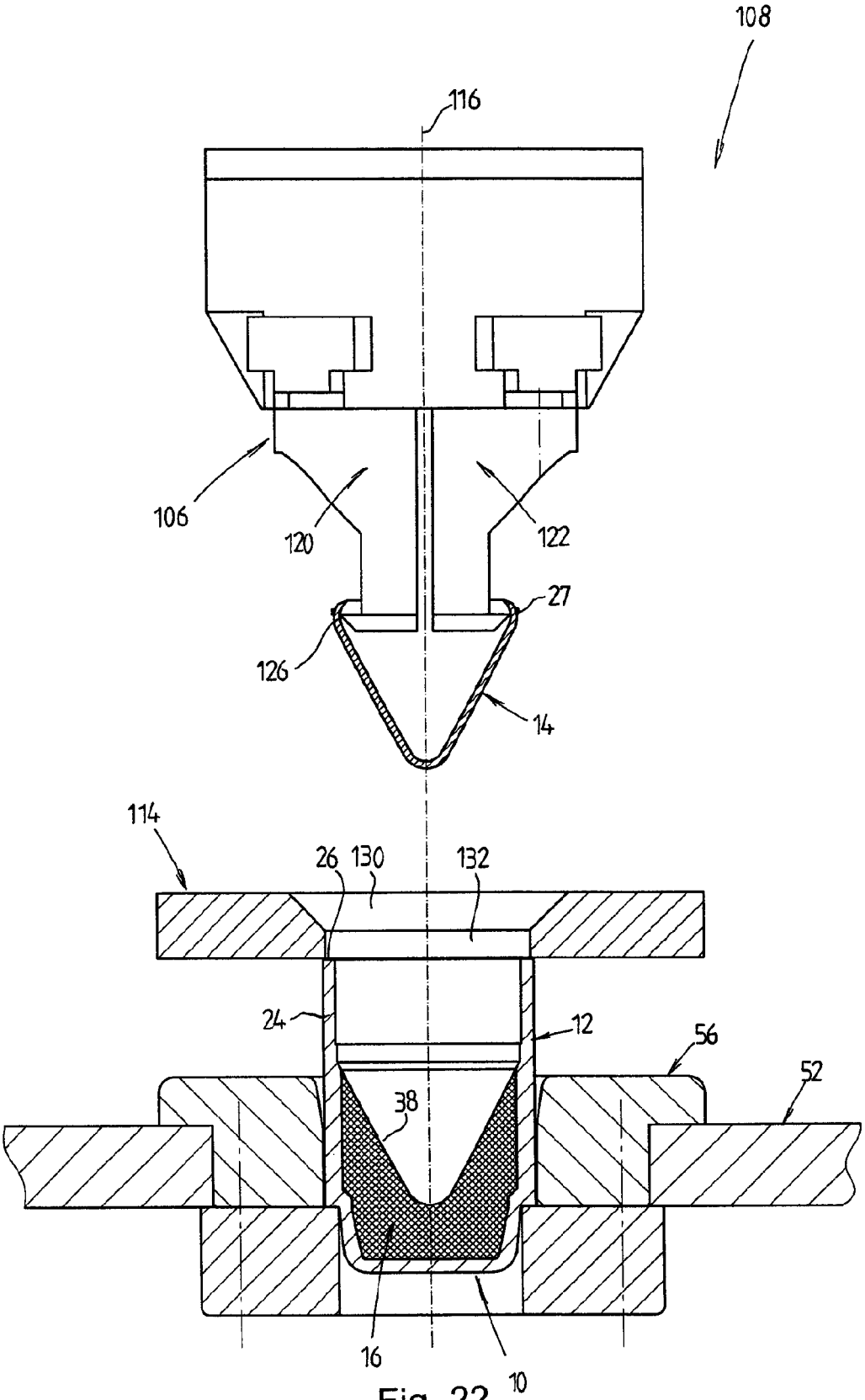
FIG. 22 is a view corresponding to FIGS. 19, 20 and 21 during a seventh step of the removal process.

The gripping and withdrawing tool 106 comprises three jaws (only two 120, 122 are visible) that can be hydraulically moved in a radial direction of the axis 116 in order to bring them into mutual abutment (FIGS. 19 and 20) or to spread them apart (FIGS. 21 and 22). Each of the three jaws 120, 122 comprises a radially outwardly projecting bottom end 124 with an angular extension of 120 degrees around the axis 116. When the jaws 120, 122 are in abutment the bottom end 124 has the shape of a flat truncated cone where the base of the cone faces upwardly, the angle of inclination of the conical surface is somewhat less than the angle of inclination of the conical portion 48 of the cone 14 and there is a sharp circumferential edge 126 between the base and the conical surface.

The guiding and clamping plate 114 can be raised and lowered along the axis 116 in order to press it from above against the upper end face 26 of the housing 12 of the shell 10, as depicted in FIGS. 19 to 22 in order to hold down the shell 10 in the seat of the support 52 and the holder 54 and prevent it from being withdrawn upwardly together with the cone 14 after the latter has been gripped by the gripping and withdrawing tool 106 and is withdrawn through the open end 20 of the tubular housing portion 24.

The horizontal guiding and clamping plate 114 has a through opening 128 with a circular cross section, an upper conical portion 130 and a lower cylindrical portion 132. The inner diameter of the lower cylindrical portion 132 is less than the outer diameter and more than the inner diameter of the end face 26 of the tubular housing portion 24 of the shell 10.

Figure 14:
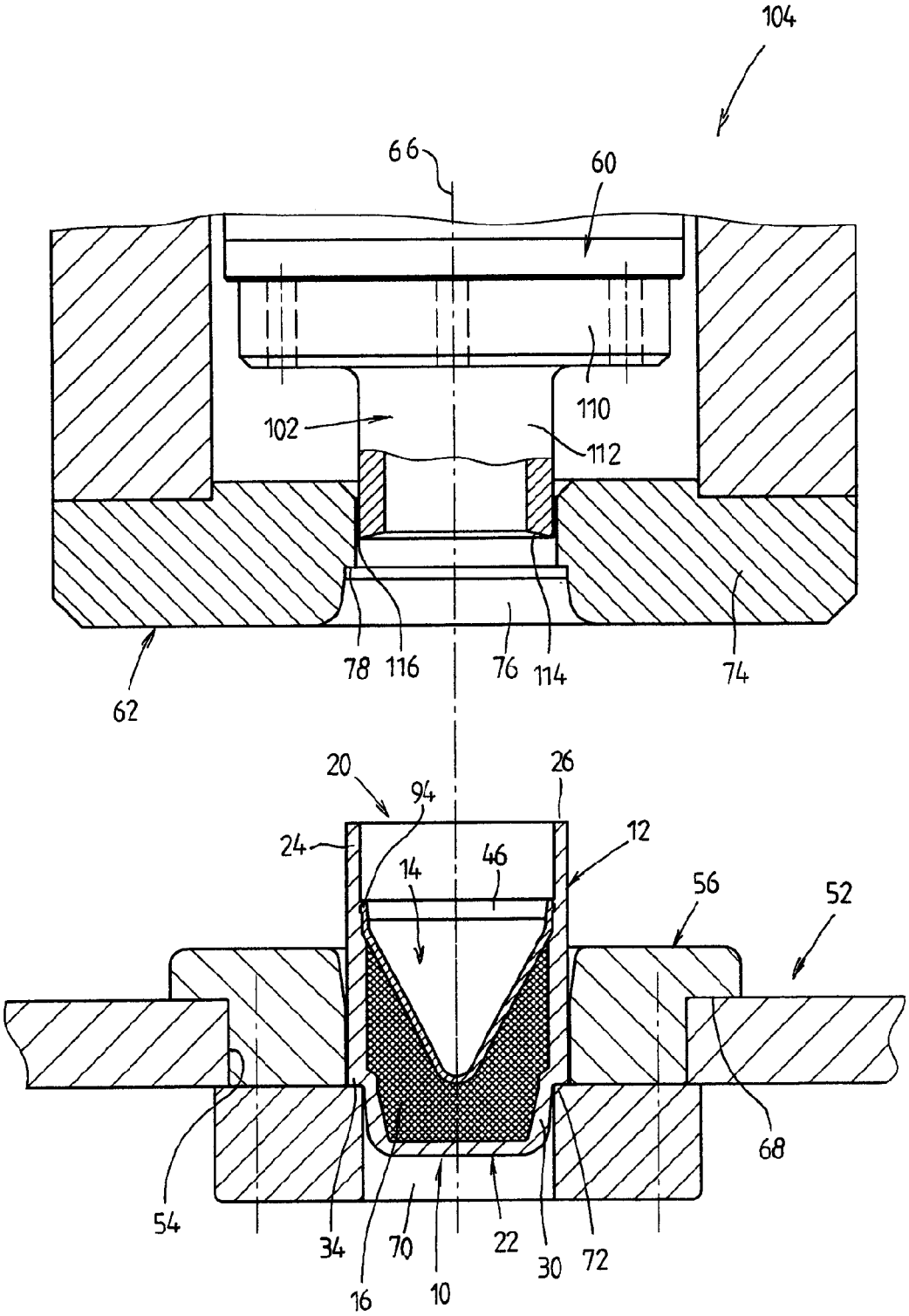
FIG. 14 is a partially cut off enlarged detailed view of a deforming station of a second embodiment of an apparatus for removing a metal cone from the ammunition in an initial or starting position of a removal process, after having dismantled the detonator.

The function of the second embodiment will be explained in the following: In an initial or starting position of the process for separating and removing the metal cone 14 from the shell 10 the housing 12 is in the seat of the holder 56 and the holder 56 is in the bore 54 of the support 52, as shown in FIG. 14. The axis of the holder 56 and the vertical axis 66 of the first station 104 are in alignment. The punch 60 with the deformation tool 102 and the alignment tool 62 are both in an upper starting position in a distance above the seat.

Figure 15:
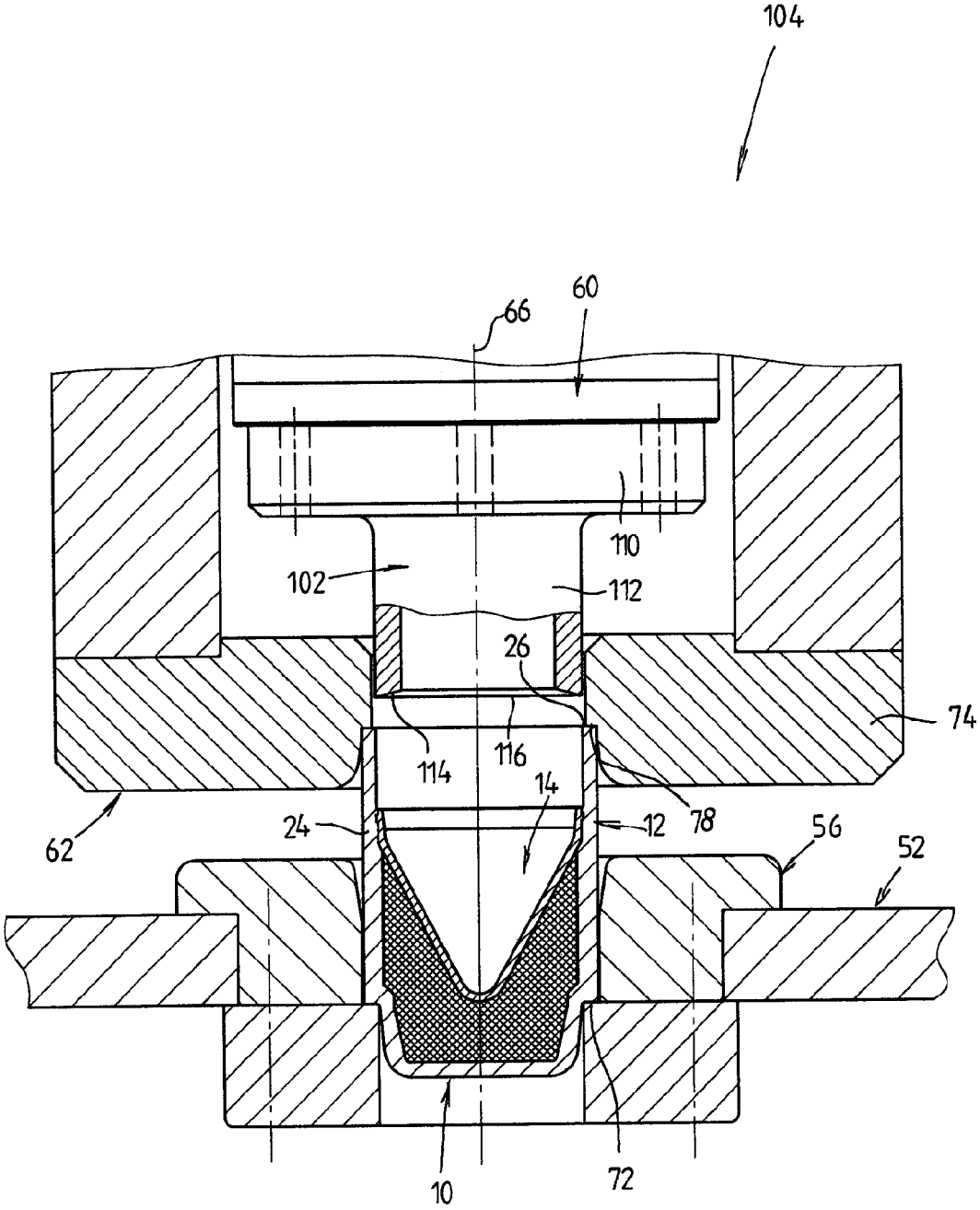
FIG. 15 is a view corresponding to FIG. 14 during a first step of the removal process.

In a first step of the process, as shown in FIG. 15, the alignment tool 62 and the punch 60 with the deformation tool 102 are both moved downwardly with respect to the support 52 into a position, where the shoulder 78 rests upon the end face 26 of the tubular housing portion 24 and the tubular housing portion 24 is clamped between the alignment tool 62 and the shoulder 72 of the two part holder 56. During the downward movement of the alignment tool 62 the open end 20 of the housing 12 will enter the recess 76, When the open end 20 of the tubular housing portion 24 has reached the upper part of the recess 76 the tubular housing portion 24 will be centered with respect to the axis 66 and therefore with respect to the alignment tool 62 and with respect to the deformation tool 102. At the end of the first step the bottom end of the lower portion 112 of the deformation tool 102 is still above the open end 20 of the tubular housing portion 24.

Figure 16:
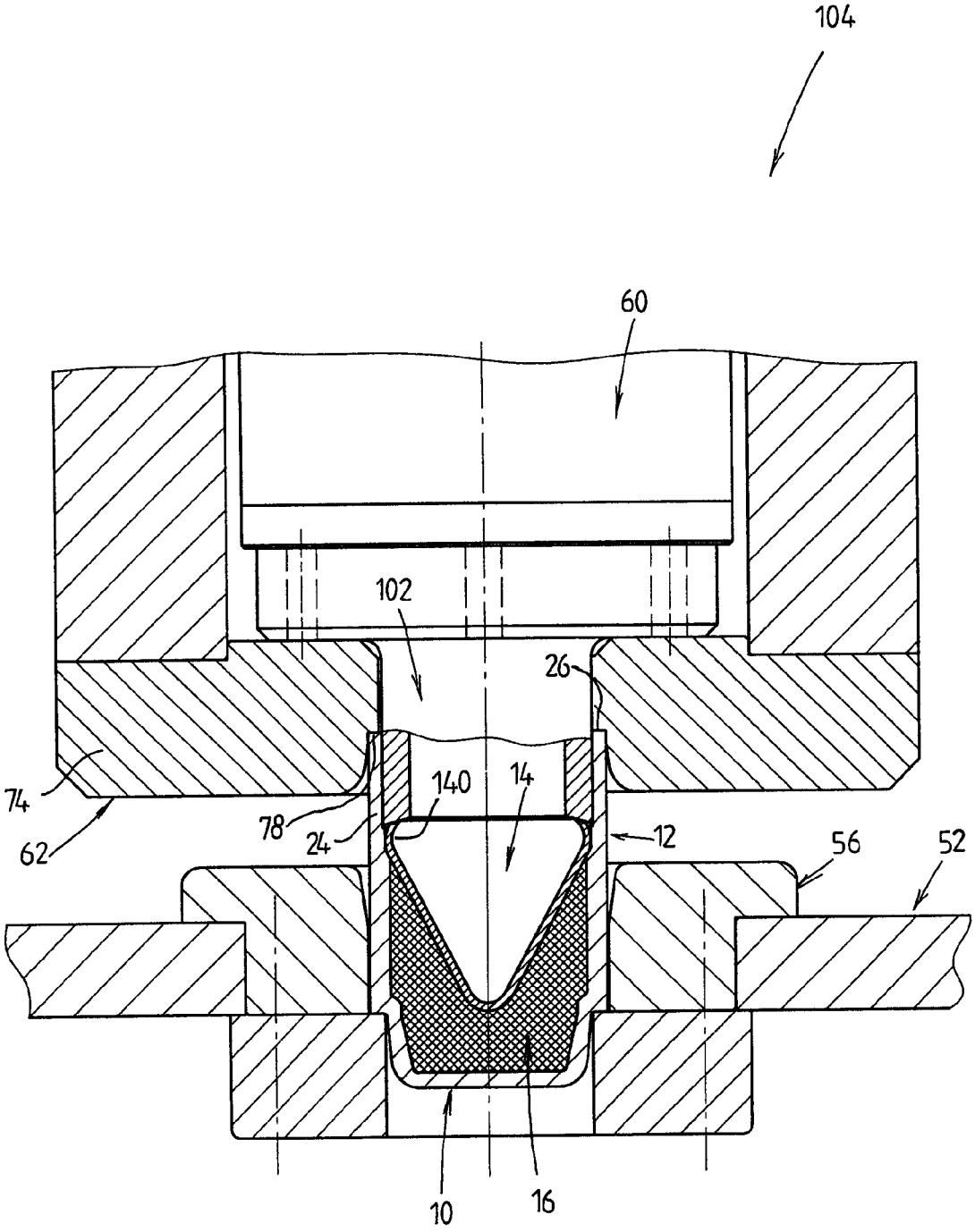
FIG. 16 is a view corresponding to FIGS. 14 and 15 during a second step of the removal process.
Figure 17:
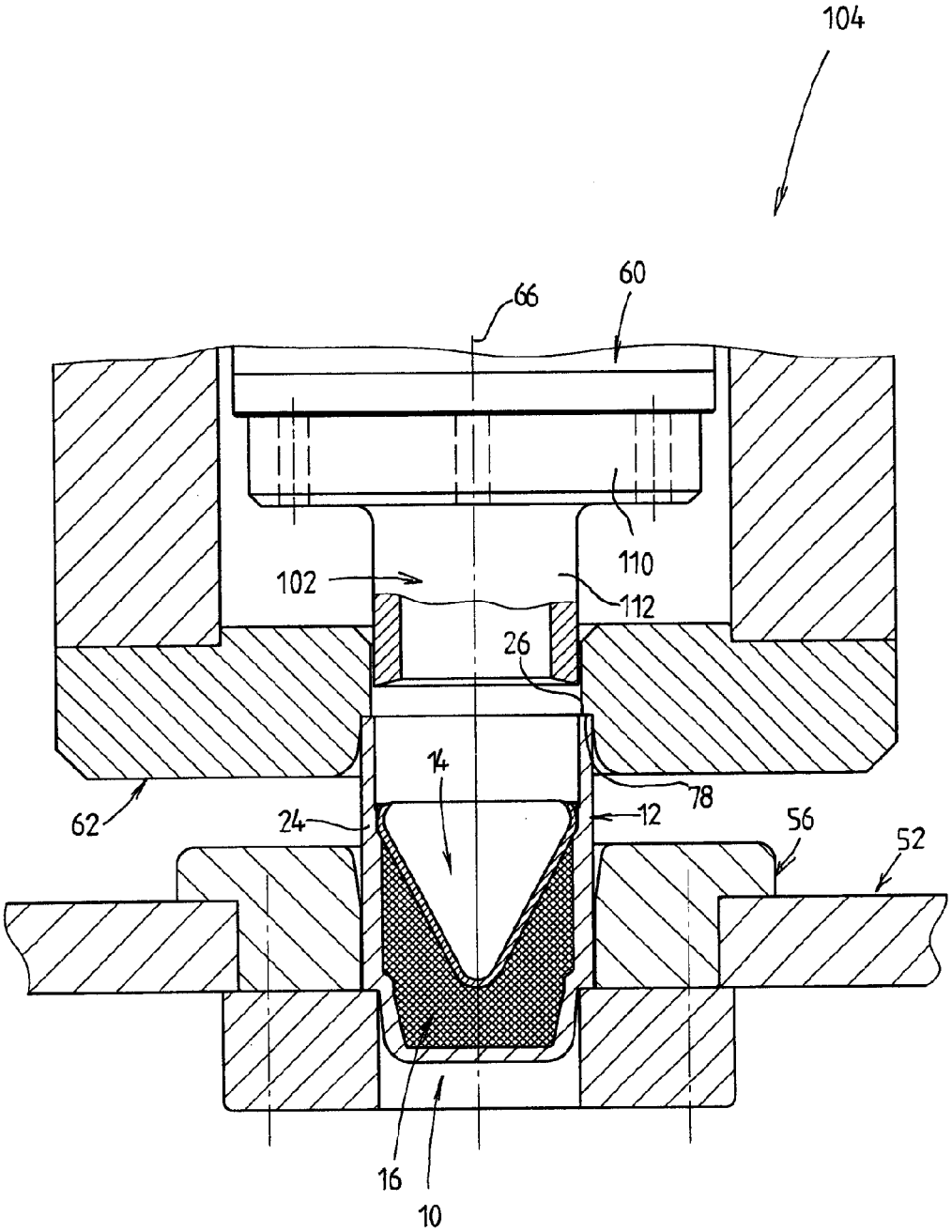
FIG. 17 is a view corresponding to FIGS. 14, 15 and 16 during a third step of the removal process.

In a second step of the process, as shown in FIG. 16, the punch 60 with the deformation tool 102 is moved downwardly with respect to the alignment tool 62 in order to introduce the lower portion 112 into the interior of the tubular housing portion 24. The downward movement is stopped when the bottom end of the upper portion 110 abuts against the upper surface of bottom wall 74 of the alignment tool 62. Due to the exact alignment of the housing portion 24 by means of the alignment tool 62 the shearing edge 84 of the deformation tool 102 will move downwardly along the interior wall surface of the tubular housing portion 24. When the edge 84 hits upon the inwardly projecting circumferential rib 27 of the housing portion 24 the steel rib 27 will be sheared off. Due to the small angle of inclination of the face 82 the edge 84 will not be damaged during the shearing. Thereafter the edge 82 will shear off the protruding external portion 50 of the rim 46 that is within the inner groove 28 of the tubular housing portion 24 from the rest of the rim 46. Furthermore the face 82 passes the level of the end face 92 of the tubular rim 46 of the cone 14 and hits the upper end portion 94 of the tubular rim 46. Due to the axial downward forces of the punch 60 that are exerted from the face 82 onto the end face 92 of the tubular rim 46 and due to the inclination of the face 82 the ductile tubular rim 46 will be bent or deformed inwardly. However at the end of the second step the cone 14 still adheres to the explosive charge 16 and to the wall of the tubular housing portion 24. The inward deformation of the tubular rim 46 is such that an undercut 140 is created beneath the end face 94.

In a third step of the process, the punch 60 with the deformation tool 102 is moved upwardly with respect to the alignment tool 62 in order to withdraw the portion 112 from the tubular housing portion 24. During the limited upward movement of the deformation tool 102 the shoulder 78 of the alignment tool 62 will rest on the end face 26 so that the alignment tool 62 will act as a hold-down clamp and prevent the shell 10 from leaving the seat due to frictional forces.

Figure 18:
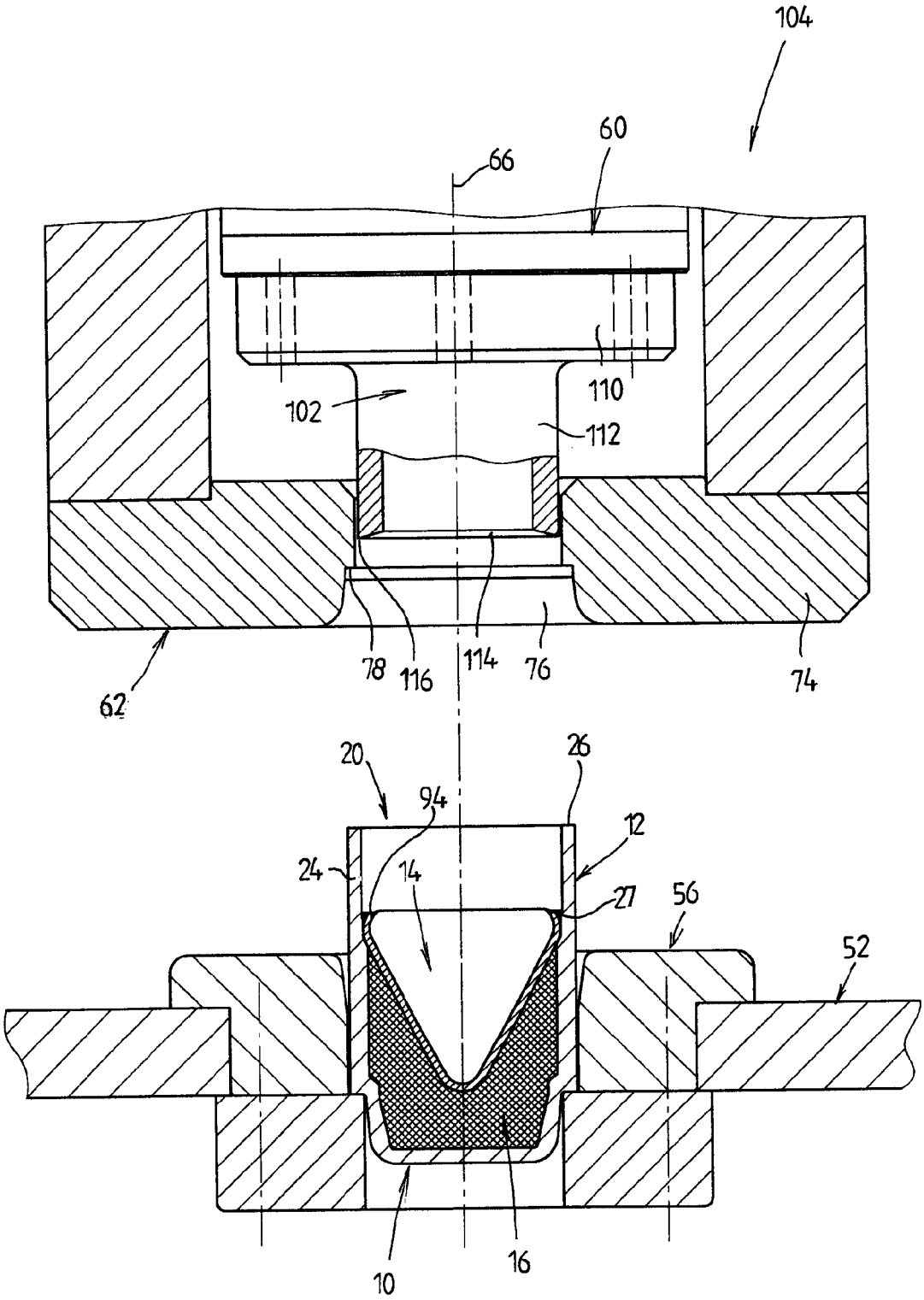
FIG. 18 is a view corresponding to FIGS. 14, 15, 16 and 17 during a fourth step of the removal process.

In a fourth step of the process, as shown in FIG. 18, the punch 60 with the deformation tool 102 and the alignment tool 62 are moved further upwardly into their upper starting position, where the tubular housing portion 24 is out of engagement with the recess 76 of the alignment tool 62. In this position the support 52 with the holder 56 and the shell 10 are free to be transported to the second station 108. When the shell 10 leaves the deforming station 104 the conical portion 48 of the cone 14 still adheres to the explosive charge 16 and the tubular rim 48 of the cone 14 is still in frictional contact with the inner wall surface of the tubular housing portion 24. The sheared off rib 27 rests upon the upper end 94 of the deformed rim 46.

Figure 19:
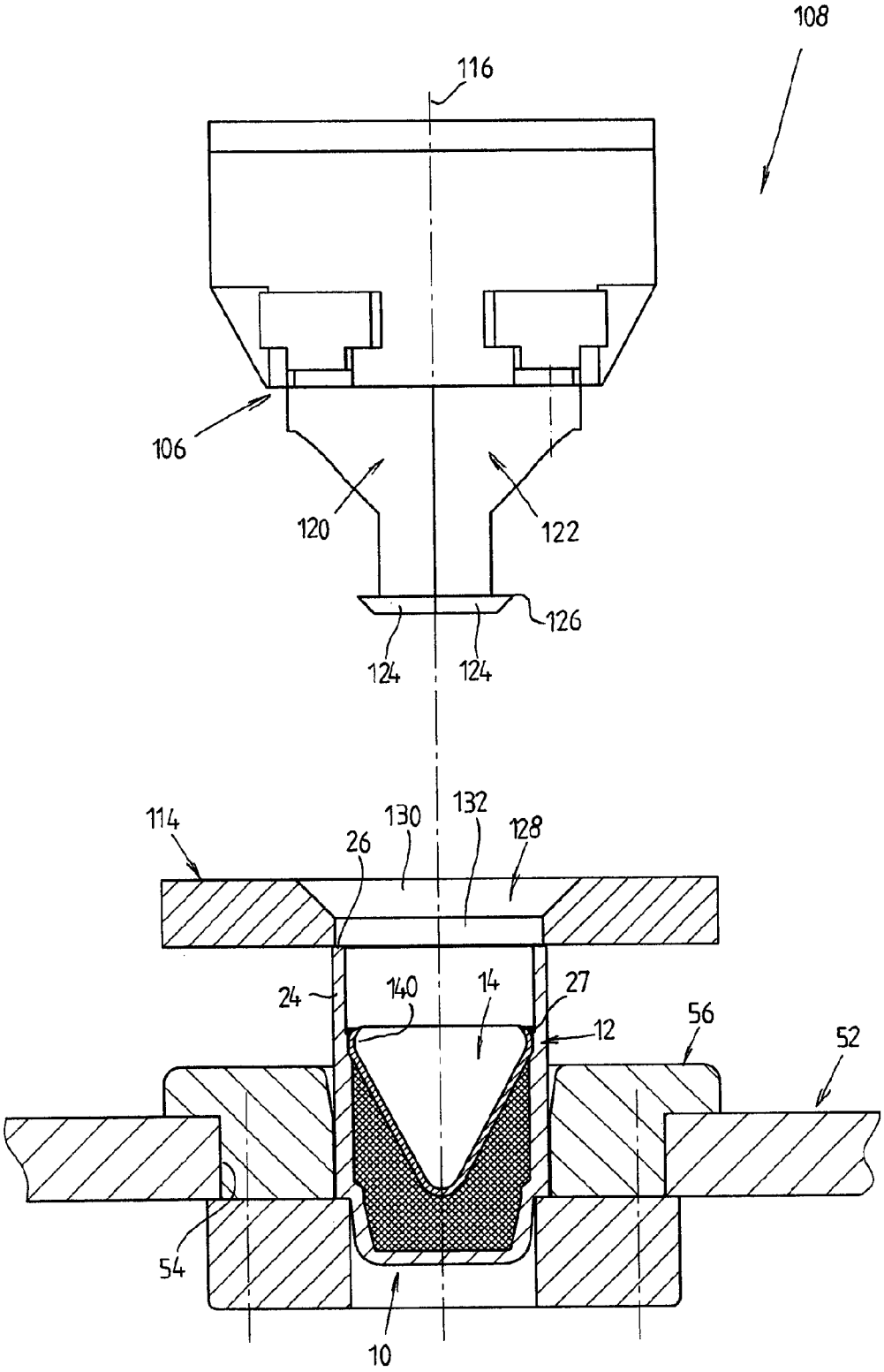
FIG. 19 is a partially cut off enlarged detailed view of a withdrawal station of the second embodiment in an initial or starting position.

When the support 52 with the holder 56 and the shell 10 are in the second station 108, where the gripping and withdrawing tool 106 and the guiding and clamping plate 114 are in an upper starting position, the vertical axis of the support 52, the holder 56 and the shell 10 are aligned with the vertical axis of the second station 108. Then the guiding and clamping plate 114 is moved downwardly into abutment with the upper end face 26 of the shell 10, as shown in FIG. 19, in order to clamp the tubular housing portion 24 in the seat.

In a fifth step of the process, the gripping and withdrawing tool 106 is moved downwardly until the radially outwardly projecting bottom end 124 of the jaws 120, 122 is about level with the largest diameter of the cone 14 or the undercut 140 respectively, as shown in FIG. 20. In this position the gripping and withdrawing tool 106 does not yet contact the wall of the conical upper portion 130 of the through opening 128 of the guiding and clamping plate 114 in order to thereafter still permit an outward radial movement of the jaws 120, 122.

In a sixth step of the process, the jaws 120, 122 of the gripping and withdrawing tool 106 are hydraulically moved radially outwardly until the sharp edge 126 of each jaw 120, 122 contacts the inside of the deformed upper rim 46 of the cone 14, as shown in FIG. 21, or is in pinching engagement therewith. In this position the gripping and withdrawing tool 106 contacts the wall of the conical upper portion 130 of the through opening 128 of the guiding and clamping plate 114.

In a seventh step of the process, the gripping and withdrawing tool 106 is moved upwardly. The force of the hydraulic drive of the gripping and withdrawing tool 106 will cause the conical portion 48 of the cone 14 to be separated from the explosive charge 16 and will cause the tubular rim 46 of the cone 14 to be moved out of frictional engagement with the tubular housing portion 24. The sheared off ledge or rib 27 is carried along with the cone 14.

During the upward movement of the gripping and withdrawing tool 106 and the cone 14 the guiding and clamping plate 114 is held stationary against the end face 26 of the shell 10 in order to hold down or clamp the tubular housing portion 24 in the seat. This is necessary because the force required to withdraw the cone 14 is more than 2000 N.

Figure 23:
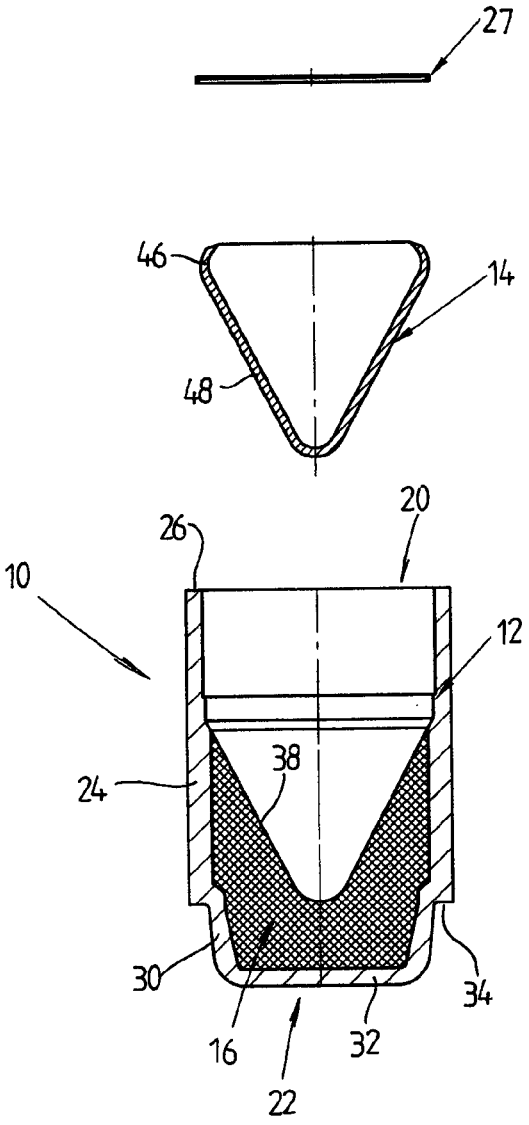
FIG. 23 is an exploded sectional view of the delaborated ammunition.

FIG. 23 depicts the sheared off ledge or rib 27 and the cone 14 that are both withdrawn from the shell 10, together with the remainder of the shell 10 that comprises the housing 12 and the explosive charge 16.

What is claimed is:

1. Method for the delaboration of ammunition, the ammunition comprising a housing with a tubular housing portion made of steel and open at one end, a cone made of ductile metal and fitted into the tubular housing portion, the cone having a base with a tubular rim, and an explosive charge contained between the housing and the cone, the method comprising the following steps:

a) inserting a deformation tool through the open end into the tubular housing portion, b) engaging the deformation tool with the tubular rim of the metal cone, c) deforming at least a portion of the tubular rim with the deformation tool, d) aligning the tubular housing portion with respect to the deformation tool by engaging the tubular housing portion with a recess of an alignment tool that surrounds the deformation tool.

2. Method according to claim 1, wherein the recess is a close fit or a sliding fit with the outer circumference of the open end of the tubular housing portion and is coaxial to the deformation tool.

3. Method according to claim 1, wherein step d) comprises clamping the tubular housing portion between a seat and the alignment tool.

4. Method according to claim 1, wherein step c) comprises: deforming the tubular rim of the cone with a plane annular face of the deformation tool, wherein an angle of inclination of the plane annular face with respect to an axis of movement of the deformation tool exceeds 60 degrees.

5. Method according to claim 4, further comprising the step of shearing off an external portion of the tubular rim of the metal cone that is in engagement with an inner circumferential groove of the tubular housing portion with the deformation tool.

6. Method according to claim 4, further comprising the step of shearing off an inwardly projecting rib of the tubular housing portion with the deformation tool.

7. Method according to claim 1, further comprising the step e) of withdrawing the cone from the tubular housing portion.

8. Method according to claim 7, wherein steps a) to d) are conducted in a first station, wherein the ammunition is transported from the first station to a remote second station after steps a) to d) and wherein step e) is conducted in the second station.

9. Method according to claim 1, further comprising the step f) of inserting the ammunition into a seat of a support, where the open end faces away from the seat.

10. Method according to claim 1, comprising a further step of removing a detonator from the ammunition before step d).

11. Apparatus for the delaboration of ammunition, the ammunition comprising a housing with a tubular housing portion made of steel and open at one end, a metal cone fitted into the tubular housing portion, the metal cone having a base with a tubular rim, and an explosive contained between the housing and the metal cone, the apparatus comprising:

at least one seat for receiving the ammunition and for holding the ammunition in a position, where the open end of the housing portion faces away from the seat;

a deformation tool, means for inserting the deformation tool into the tubular housing portion, an alignment tool for aligning the tubular housing portion with respect to the deformation tool, wherein the alignment tool has a recess for receiving an upper end of the tubular housing portion.

12. Apparatus according to claim 11, wherein the alignment tool surrounds the deformation tool and wherein the alignment tool is axially movable with respect to the seat and the deformation tool.

13. Apparatus according to claim 11, wherein at least part of the recess is a close fit with the outer circumference of the open end of the tubular housing portion and is coaxial to the deformation tool.

14. Apparatus according to claim 11, wherein an end portion of the recess that is remote from the seat has an inner diameter which corresponds to or is slightly larger than an outer diameter of the tubular housing portion and wherein an opposite end portion of the recess is tapered or flared outwardly towards the seat in order to facilitate the entry of the open end of the tubular housing portion into the recess.

15. Apparatus according to claim 11, wherein the deformation tool has a plane annular face for engaging the tubular rim of the cone and wherein an angle of inclination of the plane annular face with respect to an axis of movement of the deformation tool exceeds 60 degrees.

16. Apparatus according to claim 15, wherein the plane annular face has an outer diameter which corresponds to or is slightly less than an inner diameter of the tubular housing portion.

17. Apparatus according to claim 16, wherein the plane annular face has a sharp outer circumferential edge.

18. Apparatus according to claim 11, further comprising a withdrawal tool for withdrawing the cone from the tubular housing portion and a clamping tool for clamping the housing in a seat of a support during the withdrawal of the cone.

19. Apparatus according to claim 18, wherein the deformation tool and the alignment tool are in a first station and wherein the withdrawal tool and the clamping tool are in a second station remote from the first station.

20. Apparatus according to claim 11, further comprising a conveyor for transporting the ammunition, wherein the conveyor comprises the at least one seat for receiving the ammunition.

21. Method according to claim 1, wherein step d) precedes steps a) to c).

* * * * *